US009470011B2

(12) United States Patent
Maginot

(10) Patent No.: US 9,470,011 B2
(45) Date of Patent: Oct. 18, 2016

(54) METHOD OF SETTING UP A PORTABLE BARRIER

(71) Applicant: Shadiant, LLC., Indianapolis, IN (US)

(72) Inventor: Paul J. Maginot, Fishers, IN (US)

(73) Assignee: Shadiant, LLC, Indianapolis, IN (US)

( * ) Notice: Subject to any disclaimer, the term of this patent is extended or adjusted under 35 U.S.C. 154(b) by 0 days.

(21) Appl. No.: 14/657,783

(22) Filed: Mar. 13, 2015

(65) Prior Publication Data

US 2015/0184418 A1 Jul. 2, 2015

Related U.S. Application Data

(63) Continuation of application No. 14/170,628, filed on Feb. 2, 2014, now Pat. No. 8,978,681, which is a continuation of application No. 13/919,904, filed on Jun. 17, 2013, now Pat. No. 8,651,125, which is a (Continued)

(51) Int. Cl.

| | |
|---|---|
| ***E04H 15/48*** | (2006.01) |
| ***E04H 15/00*** | (2006.01) |
| ***E04H 15/56*** | (2006.01) |
| ***E04H 15/64*** | (2006.01) |

(52) U.S. Cl.

CPC ..... *E04H 15/48* (2013.01); *E04H 15/003* (2013.01); *E04H 15/56* (2013.01); *E04H 15/64* (2013.01)

(58) Field of Classification Search

CPC ..... E04H 15/48; E04H 15/003; E04H 15/56; E04H 15/64

USPC ..... 135/132–134, 147–149, 151, 153, 154, 135/900, 902, 905

See application file for complete search history.

(56) References Cited

U.S. PATENT DOCUMENTS

| | | | | |
|---|---|---|---|---|
| 1,913,572 A | | 6/1933 | Thonet-Drechsel | |
| 2,166,625 A | | 7/1939 | Deak | |
| 2,910,078 A | * | 10/1959 | Schunck | A45B 17/00 135/130 |
| 2,969,075 A | * | 1/1961 | Girten | E04H 15/003 135/118 |
| 2,992,649 A | | 7/1961 | Swallow | |
| 3,007,735 A | * | 11/1961 | Cohn | A47G 9/1045 135/133 |
| 3,368,575 A | | 2/1968 | Besonen | |

(Continued)

FOREIGN PATENT DOCUMENTS

| | | | | |
|---|---|---|---|---|
| GB | 2259927 A | * | 3/1993 | E04H 15/36 |

OTHER PUBLICATIONS

International Search Report and Written Opinion corresponding to PCT Application No. PCT/US2014/056058, mailed Dec. 15, 2014 (3 pages).

*Primary Examiner* — Noah Chandler Hawk

(57) ABSTRACT

A method of setting up a portable barrier includes (a) moving a first leg and a second leg away from each other to an arrangement in which a first extension portion of the first leg and a second extension portion of the second leg are each supported on a substantially horizontal surface, (b) moving a flooring from a collapsed flooring configuration to an expanded flooring configuration in response to step (a), (c) moving a first arm and a second arm away from each other, (d) moving a covering from a collapsed covering configuration to an expanded covering configuration in response to step (c), and (e) securing a supplemental component in fixed relation to the second leg after step (d). When the flooring is in the expanded flooring configuration and the covering is in the expanded covering configuration, an occupant space is defined between the flooring and the covering.

14 Claims, 29 Drawing Sheets

Related U.S. Application Data continuation of application No. 13/465,887, filed on May 7, 2012, now Pat. No. 8,464,739, which is a continuation of application No. 12/834,006, filed on Jul. 11, 2010, now Pat. No. 8,171,948, and a continuation of application No. 12/834,009, filed on Jul. 11, 2010, now Pat. No. 8,176,928, and a continuation of application No. 12/843,837, filed on Jul. 26, 2010, now Pat. No. 8,205,628, which is a continuation of application No. 12/834,006, filed on Jul. 11, 2010, now Pat. No. 8,171,948, and a continuation of application No. 12/834,008, filed on Jul. 11, 2010, now abandoned, and a continuation of application No. 12/834,009, filed on Jul. 11, 2010, now Pat. No. 8,176,928, and a continuation of application No. 12/834,011, filed on Jul. 11, 2010, now abandoned.

(56) References Cited

U.S. PATENT DOCUMENTS 3,491,781 A * 1/1970 Reese ..... A47C 7/66 135/117
3,513,861 A 5/1970 Johnson
3,581,751 A * 6/1971 Evans ..... E04H 15/48 135/120.1
3,874,398 A 4/1975 Hendrickson
4,069,833 A * 1/1978 Johansson ..... E04H 15/003 135/130
4,098,281 A * 7/1978 Bonfilio ..... E04H 15/38 135/118
4,227,542 A * 10/1980 Bonfilio ..... E04H 15/38 135/118
4,275,921 A 6/1981 Genin
4,520,835 A * 6/1985 Moeller ..... E04H 15/38 135/133
5,159,947 A 11/1992 Chuang et al.
5,271,423 A * 12/1993 Eychaner ..... E04H 15/001 135/134
5,573,027 A * 11/1996 Hsiung ..... E04H 15/48 135/142
5,752,537 A 5/1998 Kranzler
6,123,091 A 9/2000 Flynn et al.
6,439,645 B1 8/2002 Pedersen
6,823,883 B1 11/2004 Sears
7,137,399 B1 11/2006 Ransom et al.
8,079,380 B2 12/2011 Engstrom et al.
8,171,948 B2 * 5/2012 Maginot ..... E04H 15/003 135/143
8,176,928 B2 * 5/2012 Maginot ..... E04H 15/003 135/143
8,205,628 B2 * 6/2012 Maginot ..... E04H 15/003 135/143
8,464,739 B2 * 6/2013 Maginot ..... E04H 15/003 135/147
8,651,125 B2 * 2/2014 Maginot ..... E04H 15/003 135/147
2003/0046855 A1 * 3/2003 Bergdall ..... A01M 31/025 43/1
2005/0056309 A1 3/2005 Bree et al.
2009/0039685 A1 2/2009 Zernov
2012/0005879 A1 * 1/2012 Maginot ..... E04H 15/003 29/592
2012/0006372 A1 * 1/2012 Maginot ..... E04H 15/003 135/128
2012/0006374 A1 * 1/2012 Maginot ..... E04H 15/003 135/143
2012/0006375 A1 * 1/2012 Maginot ..... E04H 15/003 135/151
2012/0216846 A1 * 8/2012 Maginot ..... E04H 15/003 135/147
2014/0144475 A1 * 5/2014 Maginot ..... E04H 15/003 135/147
2015/0184418 A1 * 7/2015 Maginot ..... E04H 15/003 135/151

* cited by examiner

METHOD OF SETTING UP A PORTABLE BARRIER

This application is a continuation of U.S. patent application Ser. No. 14/170,628, entitled "Portable Barrier" by Paul J. Maginot filed on Feb. 2, 2014 (now U.S. Pat. No. 8,978,681). And U.S. patent application Ser. No. 14/170,628, entitled "Portable Barrier" by Paul J. Maginot filed on Feb. 2, 2014 (now U.S. Pat. No. 8,978,681) is a continuation of U.S. patent application Ser. No. 13/919,904, entitled "Portable Barrier" by Paul J. Maginot filed on Jun. 17, 2013 (now U.S. Pat. No. 8,651,125). And U.S. patent application Ser. No. 13/919,904 (now U.S. Pat. No. 8,651,125) is a continuation of U.S. patent application Ser. No. 13/465,887, entitled "Portable Barrier" by Paul J. Maginot filed on May 7, 2012 (now U.S. Pat. No. 8,464,739). And U.S. patent application Ser. No. 13/465,887 (now U.S. Pat. No. 8,464,739) is a continuation of each of the following applications: (i) U.S. patent application Ser. No. 12/834,006, entitled "Portable Barrier" by Paul J. Maginot filed on Jul. 11, 2010 (now U.S. Pat. No. 8,171,948), (ii) U.S. patent application Ser. No. 12/834,009, entitled "Method of Setting Up a Portable Barrier" by Paul J. Maginot filed on Jul. 11, 2010 (now U.S. Pat. No. 8,176,928), and (iii) U.S. patent application Ser. No. 12/843,837, entitled "Portable Barrier having Protection Mode and Storage Mode" by Paul J. Maginot filed on Jul. 26, 2010 (now U.S. Pat. No. 8,205,628). And the above-identified U.S. patent application Ser. No. 12/843,837 (now U.S. Pat. No. 8,205,628) is a continuation of each of the following applications: (i) U.S. patent application Ser. No. 12/834,006, entitled "Portable Barrier" by Paul J. Maginot filed on Jul. 11, 2010 (now U.S. Pat. No. 8,171,948), (ii) U.S. patent application Ser. No. 12/834,008, entitled "Portable Barrier" by Paul J. Maginot filed on Jul. 11, 2010 (now abandoned), (iii) U.S. patent application Ser. No. 12/834,009, entitled "Method of Setting Up a Portable Barrier" by Paul J. Maginot filed on Jul. 11, 2010 (now U.S. Pat. No. 8,176,928), and (iv) U.S. patent application Ser. No. 12/834,011, entitled "Portable Barrier with Side Opening Cover" by Paul J. Maginot filed on Jul. 11, 2010 (now abandoned). The disclosures of each of the eight (8) above-identified patent applications are hereby totally incorporated by reference in their entirety, namely, U.S. patent application Nos. 12/834,006; 12/834,008; 12/834,009; 12/834,011; 12/843,837; 13/465,887; 13/919,904; and 14/170,628.

BACKGROUND

The present disclosure relates generally to devices configured to protect or shield an individual from environmental elements such as the sun, wind, and rain. More particularly, the present disclosure relates to portable barriers or screening devices that can be quickly deployed at a location where protection from the elements is desired such as a beach or a sideline of a sporting event, and then readily collapsed and transported after use.

Various existing devices for protecting or shielding an individual from environmental elements have been designed. These devices, however, each have drawbacks such as being time consuming and complicated to deploy for use and collapse for subsequent transportation and storage thereof. Also, many of these devices are complicated to manufacture. In addition, the use of a traditional umbrella as a means of protecting an individual from the elements has substantial drawbacks, for example, as requiring constant manual effort or a staking mechanism to hold it upright.

These existing prior art devices fail in many aspects to meet the needs of the beach visitor, sports spectator, and outdoor enthusiast.

What is needed therefore is a portable barrier that is relatively quick and simple to deploy for use and collapse for subsequent transportation and storage thereof. What is also needed is a portable barrier that is relatively easy to manufacture. Further, what is need is a portable barrier that is relatively stable without constant attention of a user when deployed.

SUMMARY

In accordance with one embodiment, there is provided a method of setting up a portable barrier that includes (i) a junction assembly, (ii) a leg assembly including (A) a first leg having a first strut portion extending from the junction assembly, and a first extension portion that terminates in a first unsupported end, and (B) a second leg having a second strut portion extending from the junction assembly, and a second extension portion that terminates in a second unsupported end, (iii) an arm assembly including (A) a first arm having a third strut portion extending from the junction assembly, and a third extension portion that terminates in a third unsupported end, and (B) a second leg having a fourth strut portion extending from the junction assembly, and a fourth extension portion that terminates in a fourth unsupported end, (iv) a supplemental component movable with respect to the second arm, (v) a flooring configured to be moved between a collapsed flooring configuration and an expanded flooring configuration, and (vi) a covering configured to be moved between a collapsed covering configuration and an expanded covering configuration. The method includes (a) moving the first leg and the second leg away from each other to an arrangement in which the first extension portion and the second extension portion are each supported on a substantially horizontal surface; (b) moving the flooring from the collapsed flooring configuration to the expanded flooring configuration in response to step (a); (c) moving the first arm and the second arm away from each other; (d) moving the covering from the collapsed covering configuration to the expanded covering configuration in response to step (c), and (e) securing the supplemental component in fixed relation to the second leg after step (d). When the flooring is in the expanded flooring configuration and the covering is in the expanded covering configuration, an occupant space is defined between the flooring and the covering. Further, after step (e): (i) the first strut portion is positioned to extend in a first direction away from the junction assembly and toward the horizontal surface, (ii) the second strut portion is positioned to extend in a second direction away from the junction assembly and toward the horizontal surface, (iii) the third strut portion is positioned to extend in a third direction away from the junction assembly and away from the horizontal surface, (iv) the fourth strut portion is positioned to extend in a fourth direction away from the junction assembly and away from the horizontal surface, and (v) the fifth strut portion is positioned to extend in a fifth direction away from the junction assembly and toward the horizontal surface.

DESCRIPTION OF THE PREFERRED EMBODIMENTS

Figure 1:
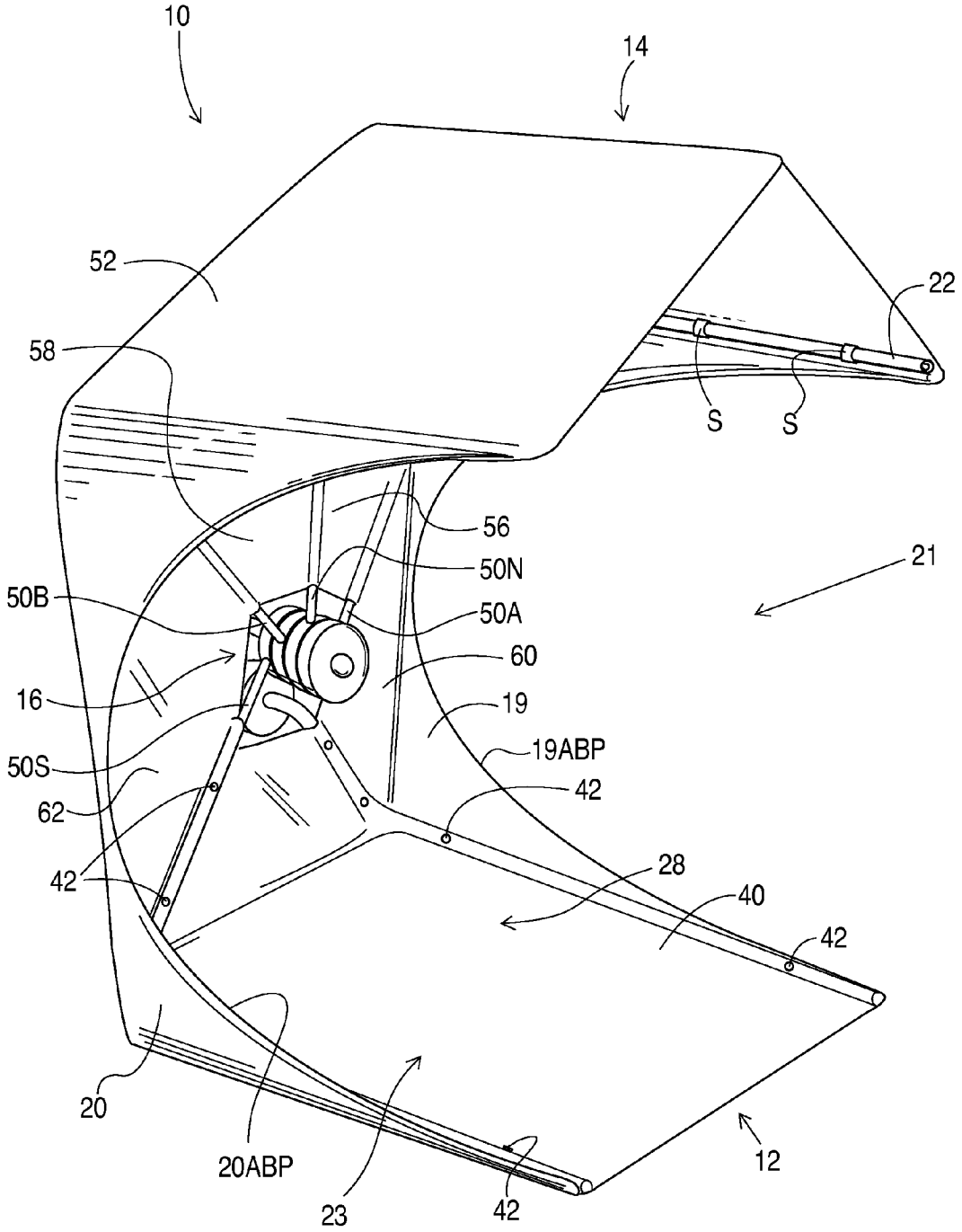
FIG. 1 is a perspective view of a portable barrier of the present disclosure, with the portable barrier shown in its protection mode of operation.

While the portable barrier described herein is susceptible to various modifications and alternative forms, specific embodiments thereof have been shown by way of example in the drawings and will herein be described in detail. It should be understood, however, that there is no intent to limit the portable barrier to the particular forms disclosed, but on the contrary, the intention is to cover all modifications, equivalents, and alternatives falling within the spirit and scope of the invention as defined by the appended claims.

Referring now to FIGS. 1-5, there is shown a portable barrier 10 that incorporates the features of the present disclosure. The portable barrier 10 includes a pedestal assembly 12 and a cover assembly 14. The portable barrier 10 further includes a junction assembly 16 interposed between the pedestal assembly and the cover assembly. The junction assembly includes a generally U-shaped support 17 and a plurality of connectors or pivot disks 18. The U-shaped support includes an upper post 17UP that defines an axis A1 lying on a line and a lower post LP that defines another axis A2 lying on a line. (See, e.g., FIG. 16.) The lines defined by the axis A1 and axis A2 are parallel with respect to each other.

The portable barrier 10 also includes a limiter or side screen 19 and a limiter or side screen 20. The side screen 19 has a concave anterior border portion 19ABP that defines a side opening 21 (see FIG. 4). Similarly, the side screen 20 has a concave anterior border portion 20ABP that defines a side opening 23 (see FIG. 2). In addition, the portable barrier includes a side opening cover 22 and a side opening cover 24. (See FIG. 24.)

Figure 3:
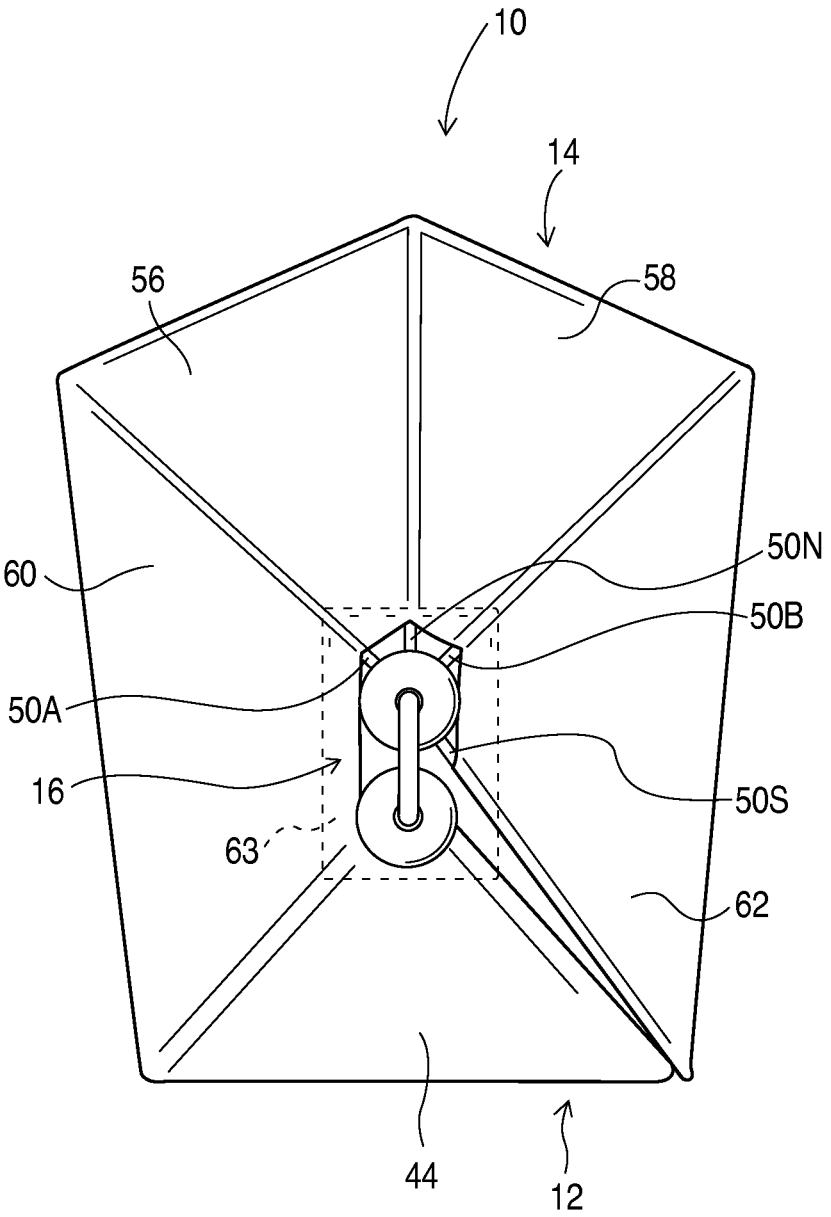
FIG. 3 is a rear elevational view of the portable barrier of FIG. 1, with the portable barrier shown in its protection mode of operation.
Figure 4:
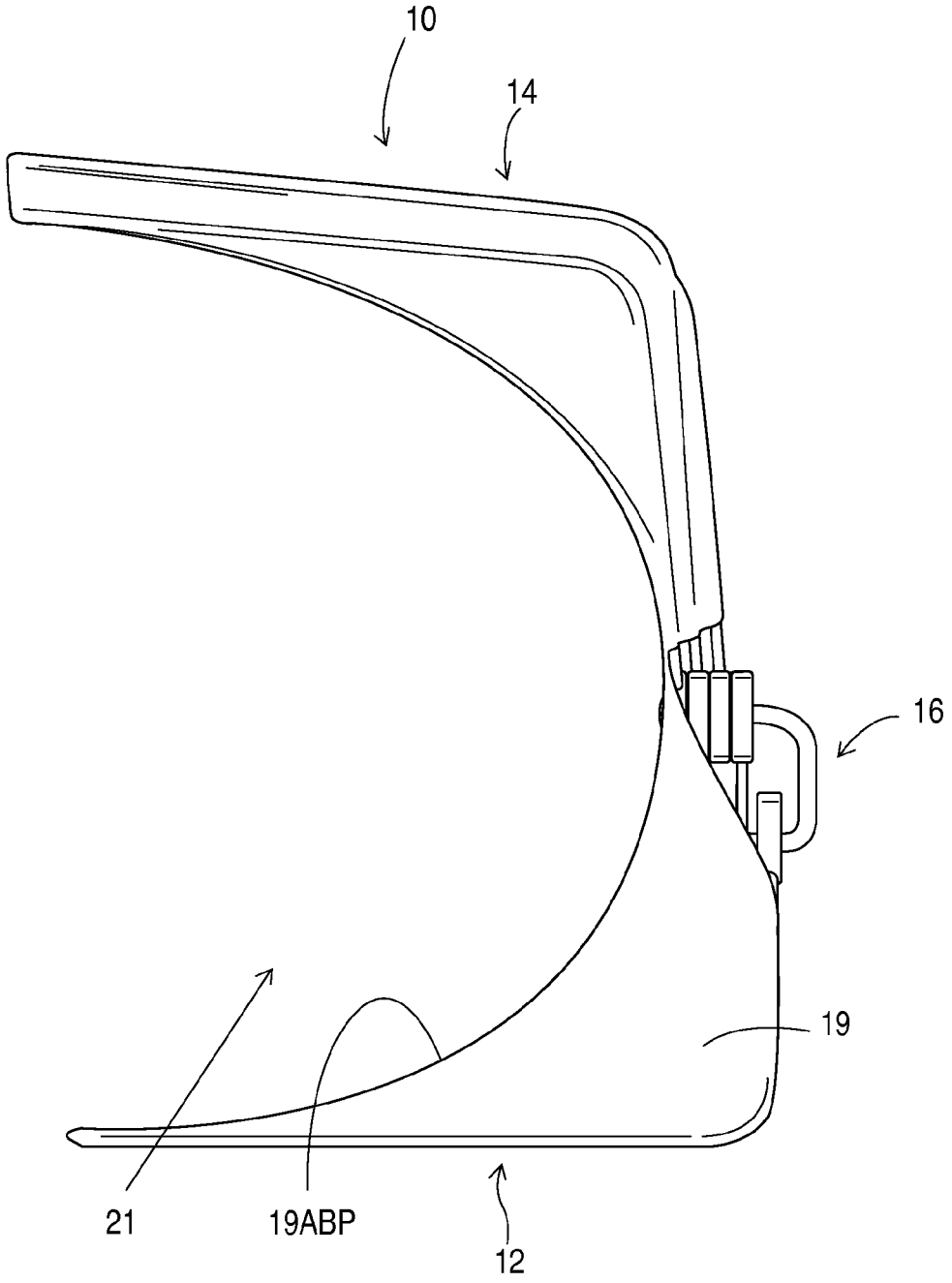
FIG. 4 is a left side elevational view of the portable barrier of FIG. 1, with the portable barrier shown in its protection mode of operation.
Figure 5:
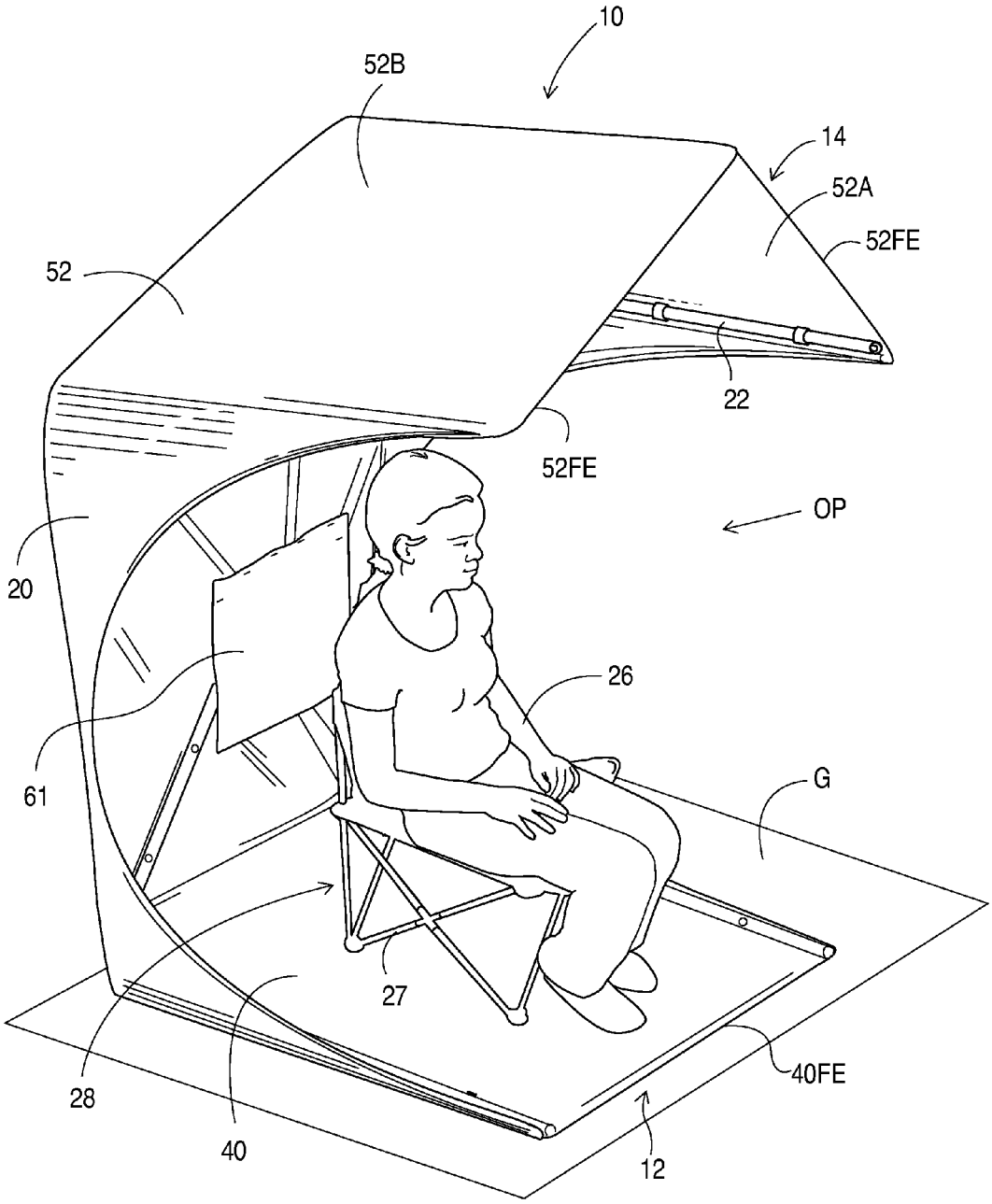
FIG. 5 is a view similar to FIG. 1, with a user shown located within a cavity or occupant space created by the portable barrier when the portable barrier is in its protection mode of operation.
Figure 6:
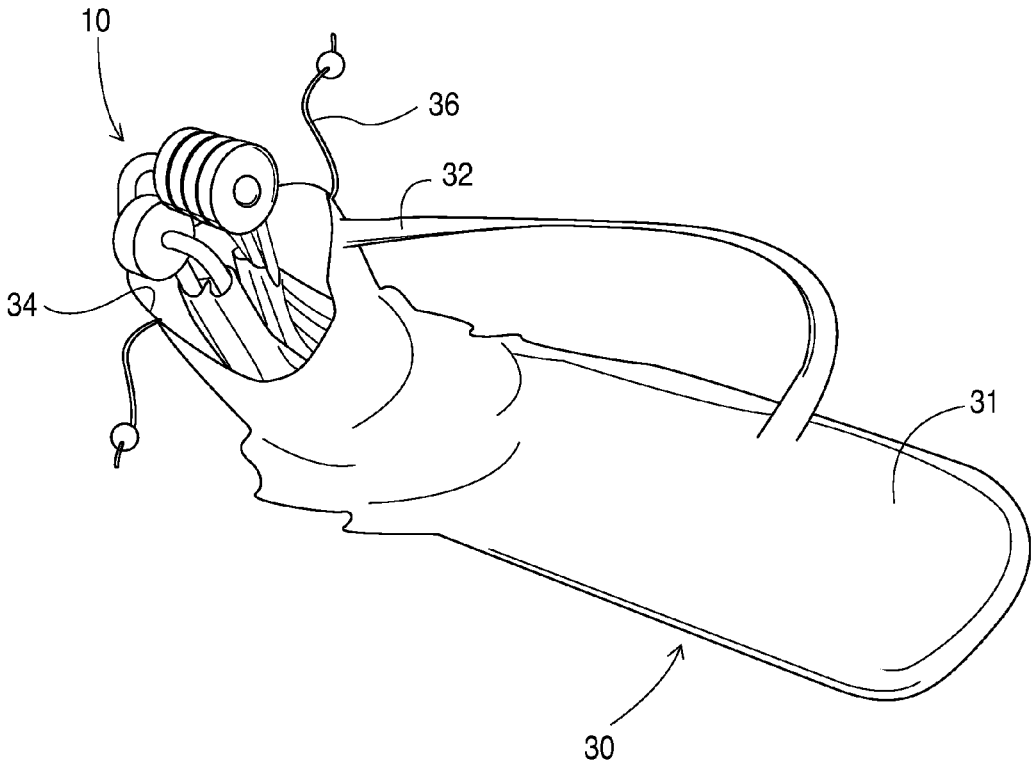
FIG. 6 is a perspective view of the portable barrier of FIG. 1, with the portable barrier shown in its storage mode of operation, and further with the portable barrier shown partially located within a tote bag.
Figure 7:
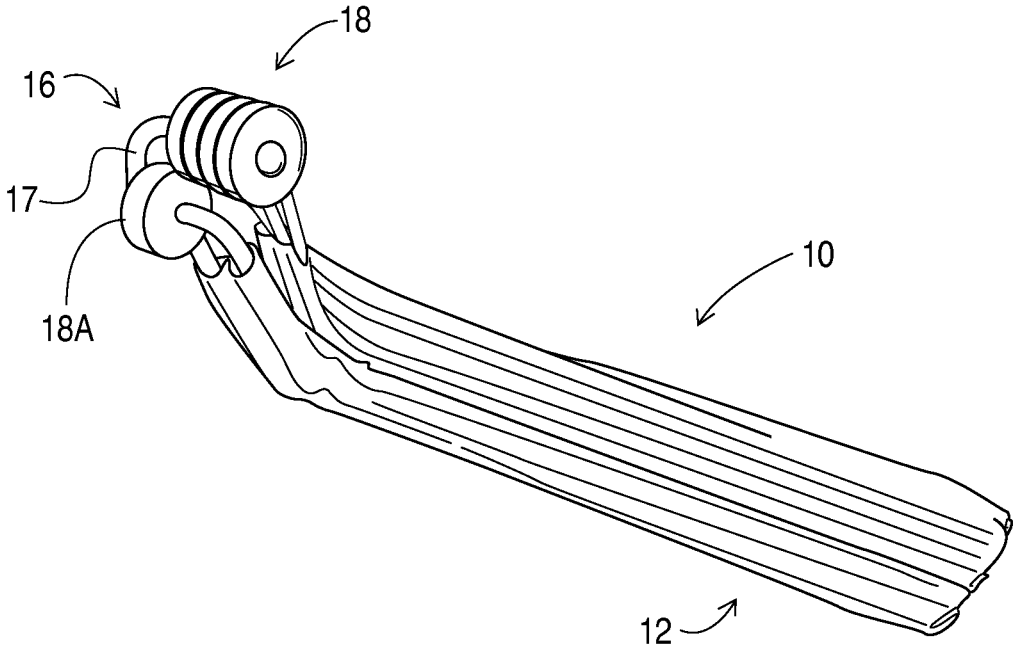
FIG. 7 is a perspective view of the portable barrier of FIG. 1, with the portable barrier shown in its storage mode of operation, and further with the portable barrier shown removed and spaced apart from the tote bag of FIG. 6.

The portable barrier 10 is configured to be moved between a protection mode of operation as shown in FIGS. 1-5 and a storage mode of operation as shown in FIGS. 6-7. When in the protection mode, the portable barrier 10 is configured to assume an expanded configuration which enables protection of an occupant 26 located in a cavity or occupant space 28 defined by the portable barrier as shown in FIG. 5. For example, the portable barrier 10 protects the occupant 26 from exposure to sun, wind, and/or rain while positioned in the occupant space 28 such as while the occupant is sitting in a chair 27 that is located in the occupant space and the chair is supported on a flooring of the portable barrier. (See FIG. 5.). The side openings 21, 23 defined in the side screens 19, 20 allow the occupant 26 to view laterally out of the portable barrier 10. When in the storage mode, the portable barrier 10 is configured in a collapsed configuration which facilitates convenient transportation and storage of the portable barrier.

When in the storage mode, the portable barrier 10 is configured to be stowed in a flexible carrier bag 30 as shown in FIG. 6 so as to facilitate convenient transportation and subsequent long term storage of the portable barrier. The carrier bag 30 includes a sleeve portion 31 having an open end and a closed end. The carrier bag 30 also includes a flexible handle 32 such as a strap connected to a side of the sleeve portion 31 The sleeve portion 31 defines a cavity 34 in which the portable barrier 10 is located during transportation and storage. (See FIG. 6.) The carrier bag 30 further includes a draw string 36 which is slidably attached to the sleeve portion 31 and configured to be pulled at its ends to cinch the sleeve portion closed thereby trapping the portable barrier 10 within the carrier bag 30 for ready transportation and ultimate storage at a storage location such as an occupant's garage or basement.

Pedestal Assembly

The pedestal assembly 12 includes a plurality of legs 38 that are movable with respect to each other. The pedestal assembly 12 is configured to be moved from an expanded configuration as shown in FIGS. 1-5 to a collapsed configuration as shown in FIGS. 6-7. The plurality of legs 38 includes a lateral leg 38A and a lateral leg 38B (see, e.g., FIGS. 13-19). The lateral leg 38A includes a free end 38A-FE and a connected end 38A-CE, while the lateral leg 38B includes a free end 38B-FE and a connected end 38B-CE. While the pedestal assembly 12 includes only two legs in the embodiments shown in the figures of the present disclosure, it should be appreciated that alternative embodiments of the pedestal assembly 12 may include more than two legs such as three or four legs.

Figure 18:
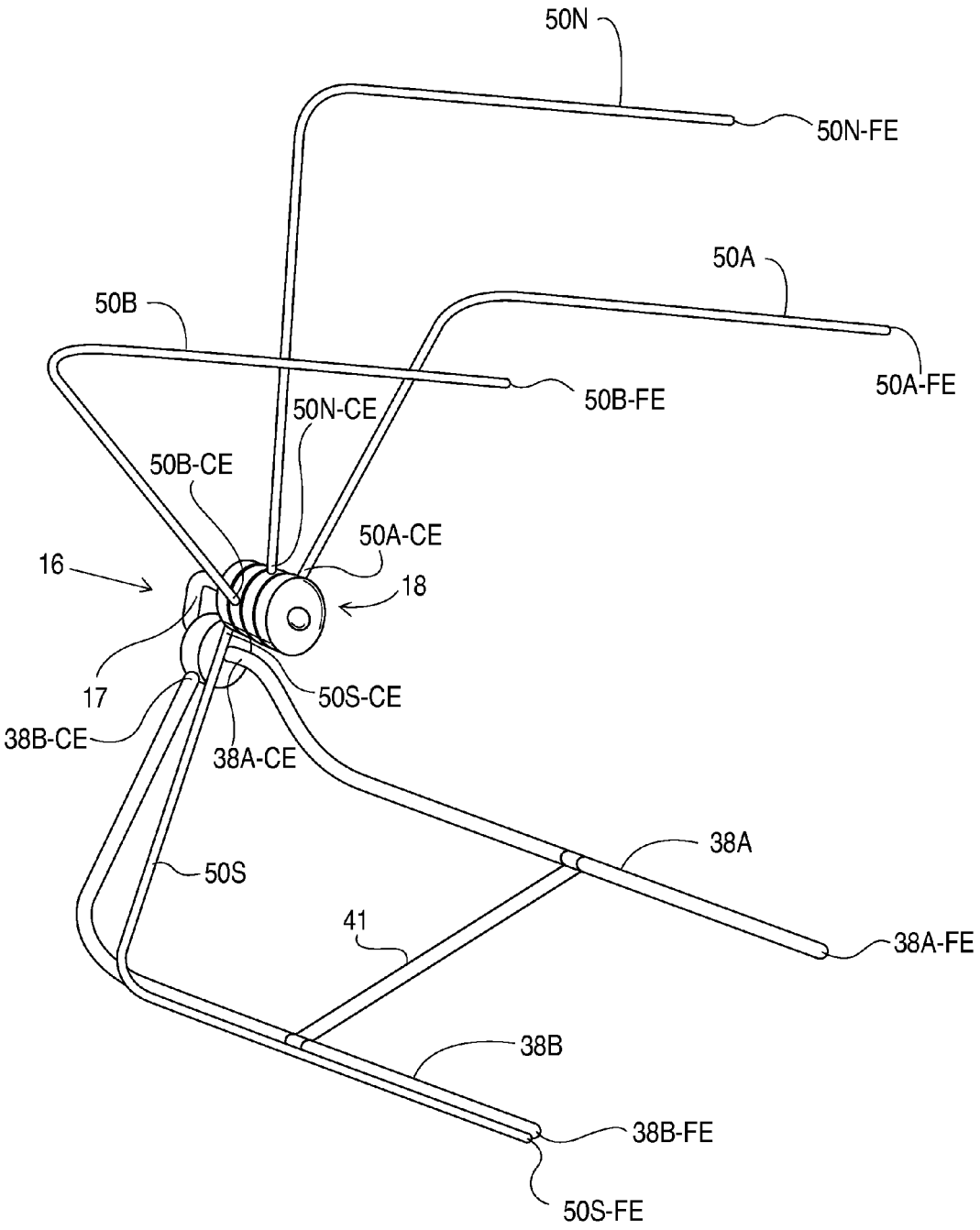
FIG. 18 is a perspective view of the framework of the portable barrier of FIG. 1, with the framework shown when the portable barrier is fully deployed in its protection mode of operation such as shown in FIG. 12.

The pedestal assembly 12 further includes a limiter or flooring 40 that is connected to the lateral leg 38A and the lateral leg 38B. In particular, a plurality of fasteners 42, such as screws or rivets, is secured to the legs 38 to connect the flooring 40 to the legs. Such a fastening arrangement is commonly used to secure flexible material to posts in commercially available portable chairs comprised of flexible material and pivoting posts. The legs 38 are made of a metallic material such as steel or aluminum. The legs 38 may be made from the same materials used to make posts of commercially available portable chairs comprised of flexible material and pivoting posts. Also, the flooring 40 is made of a fabric material such as a polyethylene fabric or polyester fabric. The flooring 40 may be made from the same material that is used to make the flooring of commercially available tents. Similarly, the flooring may be made from the same materials used to make the seat portion of commercially available portable chairs comprised of flexible material and pivoting posts. In an alternative embodiment, the limiter 40 is a flexible strap 41 that is connected between the lateral leg 38A and the lateral leg 38B as shown in FIG. 18.

The lateral legs 38A, 38B are each connected to the support 17 of the junction assembly 16. In particular, the lateral leg 38A is fixed in relation to the support 17, while the lateral leg 38B is pivotably connected to the support. The lateral leg 38A is attached to the support 17 by being integrally formed therewith as a single metal tube that is bent to form the lateral leg 38A and the support 17. The lateral leg 38B is pivotably attached to the support 17 by being fixedly attached to one of the pivot disks 18A, while the pivot disk 18A is rotatably mounted around a lower post of the support 17 as shown in 13-14. During movement of the portable barrier 10 from its protection mode (see FIG. 1) to its storage mode (see FIG. 7), the lateral leg 38B pivots about a line defined by the axis A2 (see FIG. 16). A C-ring (not shown) may be located in a groove (not shown) defined in the lower post of the support 17 on each side of the pivot disk 18A to prevent axial movement of the pivot disk 18A with respect to the support 17. It should be appreciated that the flooring 40 is attached to the lateral legs 38A, 38B so that the extent of movement between the lateral leg 38A and the lateral leg 38B is limited. More specifically, the lateral leg 38A is allowed to move in relation to the lateral leg 38B from the collapsed arrangement of the pedestal assembly 12 shown in FIGS. 7 and 13 to the expanded arrangement of the pedestal assembly shown in FIGS. 8 and 14.

The pedestal assembly 12 further includes a back cover segment 44 that extends between the lateral leg 38A and the lateral leg 38B. The back cover segment 44 is attached to the legs 38A, 38B by fasteners such as screws or rivets. The back cover segment 44 is made from the same material as the flooring 40. It should be appreciated that the back cover segment 44 and the flooring 40 are collectively made from a single piece of material that is fastened to the legs 38A, 38B with fasteners.

Cover Assembly

Figure 20:
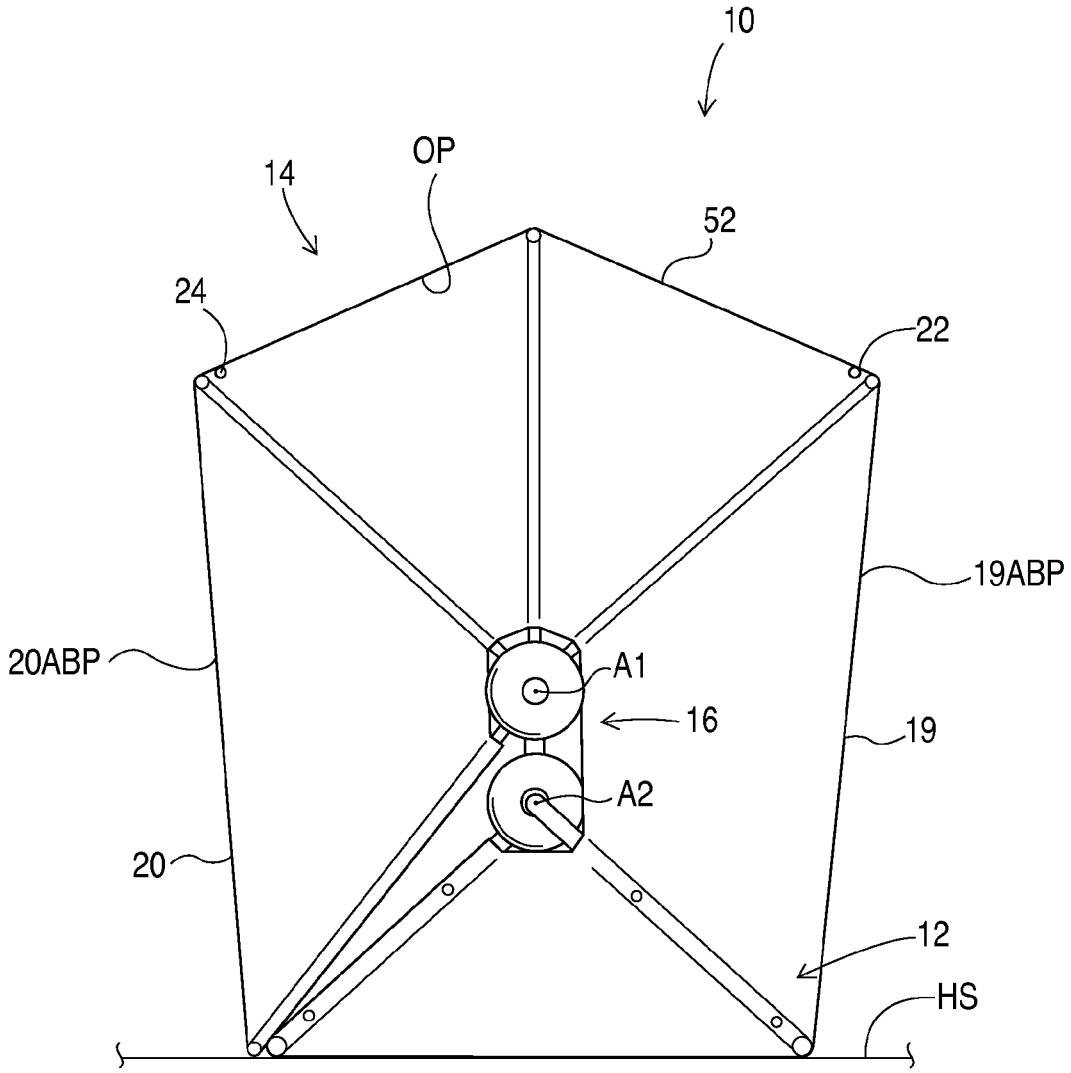
FIG. 20 is a front elevational view of the portable barrier of FIG. 1 when the portable barrier is positioned in its protection mode of operation.

The cover assembly 14 includes a plurality of arms 50 that are movable with respect to each other. The cover assembly 14 is configured to be moved from an expanded configuration as shown in FIGS. 1-5 to a collapsed configuration as shown in FIGS. 6-7. As shown in FIG. 20, the cover assembly 14 is supported above the pedestal assembly 12 when both (i) the portable barrier 10 is positioned in the protection mode, and (ii) the pedestal assembly 10 is supported on a generally horizontal surface HS (see FIG. 20) such as the ground adjacent to a sports field or a sandy surface at a beach.

The plurality of arms 50 includes a lateral arm 50A, a lateral arm 50B, and an intermediate arm 50N. Note that the portable barrier also includes a supplemental arm 50S which is not part of the cover assembly 14, and will be discussed in more detail hereinafter. As shown in FIGS. 1 and 18, the supplemental arm 50S is juxtaposed to the lateral leg 38B when the portable barrier 10 is positioned in the protection mode.

As shown in FIG. 18, the lateral arm 50A includes a free end 50A-FE and a connected end 50A-CE, while the lateral arm 50B includes a free end 50B-FE and a connected end 50B-CE. Similarly, the intermediate arm 50N includes a free end 50N-FE and a connected end 50N-CE, while the supplemental arm 50S includes a free end 50S-FE and a connected end 50S-CE. While the cover assembly 14 utilizes three arms in the embodiments shown in the figures of the present disclosure, it should be appreciated that alternative embodiments of the cover assembly 14 may include more or less than three arms such as two, four, or five arms.

The cover assembly 12 further includes a covering 52 that includes a cover segment 52A and a cover segment 52B as shown in FIG. 5. The cover segment 52A extends between the lateral arm 50A and the intermediate arm 50N, while the cover segment 52B extends between the intermediate arm 50N and the lateral arm 50B. In addition, the covering 52 is connected to the lateral arm 50A, the intermediate arm 50N, and the lateral arm 50B. In particular, a plurality of fasteners (not shown), such as screws or rivets, are secured to the arms 50 to connect the covering 52 to the arms 50A, 50B, 50N. The same manner of securing the flooring 40 and the back cover segment 44 with fasteners 42 to the legs 38 is used to secure the covering 52 to the arms 50. The arms 50 are made of a somewhat flexible material such as fiberglass or plastic, or may be made of a more rigid material such as a metallic material such as steel or aluminum. The arms 50 may be made from the same material that is used to make the posts of commercially available tents. Also, the covering 52 is made of a fabric material such as polyethylene fabric or polyester fabric. The covering 52 may be made from the same material that is used to make the walls and ceilings of commercially available tents.

The lateral arms 50A, 50B and the intermediate arm 50N and supplemental arm 50S are each connected to the support 17 of the junction assembly 16. In particular, the lateral arms 50A, 50B and the intermediate arm 50N and the supplemental arm 50S are each pivotably attached to the support 17 by being fixedly attached to respective one of the pivoting disks 18B, 18C, 18D, 18E, while the pivoting disks 18B, 18C, 18D, 18E are respectively rotatably mounted around an upper post of the support 17 as shown in 13-19. During movement of the portable barrier 10 from its protection mode (see FIG. 1) to its storage mode (see FIG. 7), each of the lateral arms 50A, 50B, the intermediate arm 50N, and the supplemental arm 50S pivots about a line defined by the axis A1 (see FIG. 16).

In an alternative embodiment (not shown), the configuration of the support 17 may be modified to not be generally U-shaped but rather be linearly shaped, and all the plurality of disks 18A, 18B, 18C, 18D, 18E are movable mounted on the linearly shaped support. In this alternative embodiment, during movement of the portable barrier 10 from its protection mode (see FIG. 1) to its storage mode (see FIG. 7), each of the lateral arms 50A, 50B, the intermediate arm 50N, and the supplemental arm 50S, as well as, the lateral leg 38B pivots about the axis defined by the linearly shaped support.

Figure 11:
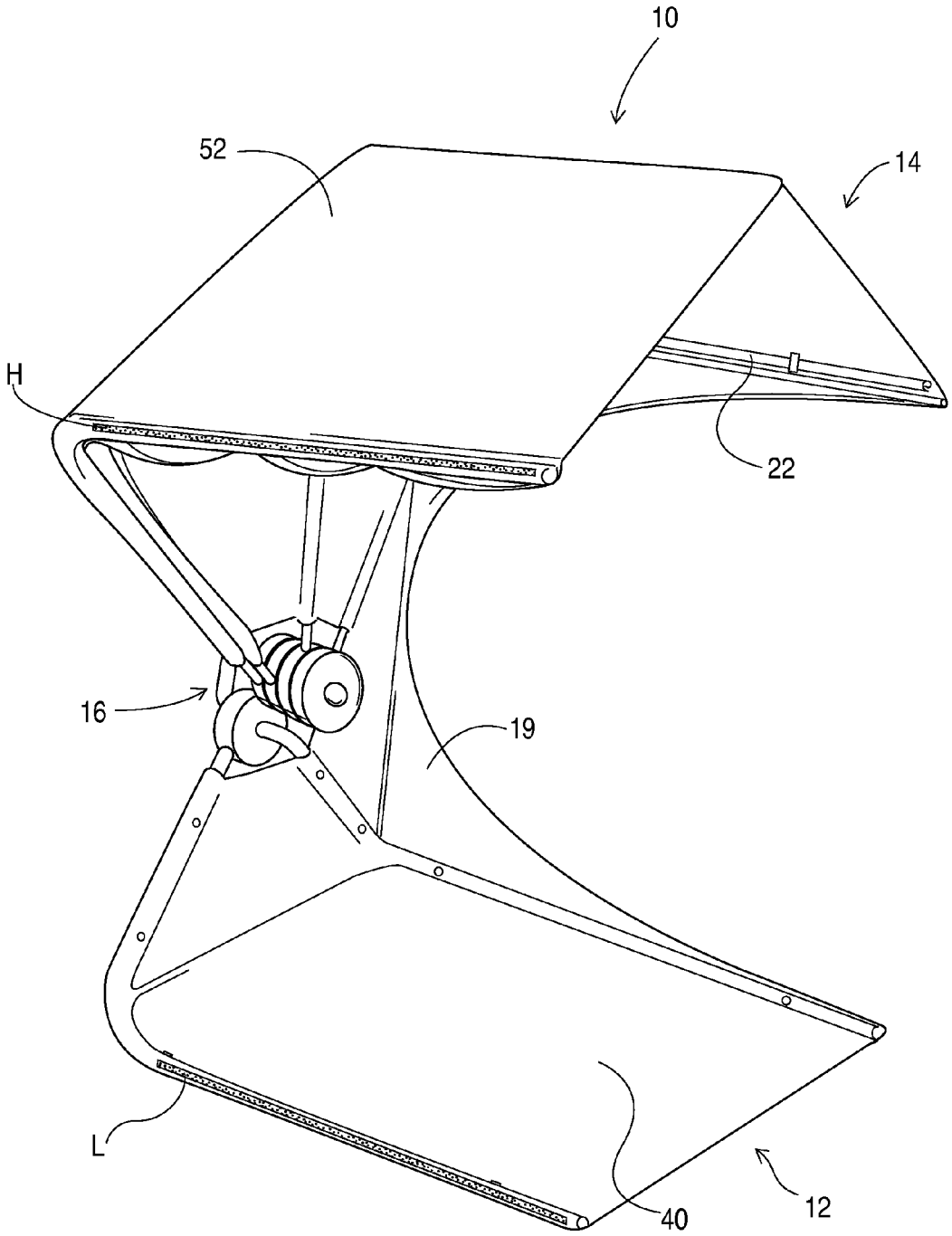

A C-ring (not shown) may be located in a groove (not shown) defined in the upper post of the support 17 on each side of the stack of pivot disks 18B, 18C, 18D, 18E to prevent axial movement of the pivot disks 18B, 18C, 18D, 18E with respect to the support 17. It should be appreciated that the covering 52 is attached to the lateral arms 50A, 50B and the intermediate arm 50N so that the extent of movement between the lateral arm 50A, the intermediate arm 50N, and the lateral arm 50B is limited. More specifically, the lateral arm 50A is allowed to move in relation to the lateral arm 50B from the collapsed arrangement of the cover assembly 14 shown in FIGS. 7 and 13 to the expanded arrangement of the cover assembly shown in FIGS. 1 and 11. Similarly, the lateral arm 50A is allowed to move in relation to the intermediate arm 50N from the collapsed arrangement of the cover assembly 14 shown in FIGS. 7 and 13 to the expanded arrangement of the cover assembly shown in FIGS. 1 and 11. And likewise, the intermediate arm 50N is allowed to move in relation to the lateral arm 50B from the collapsed arrangement of the cover assembly 14 shown in FIGS. 7 and 13 to the expanded arrangement of the cover assembly shown in FIGS. 1 and 11.

Figure 24:
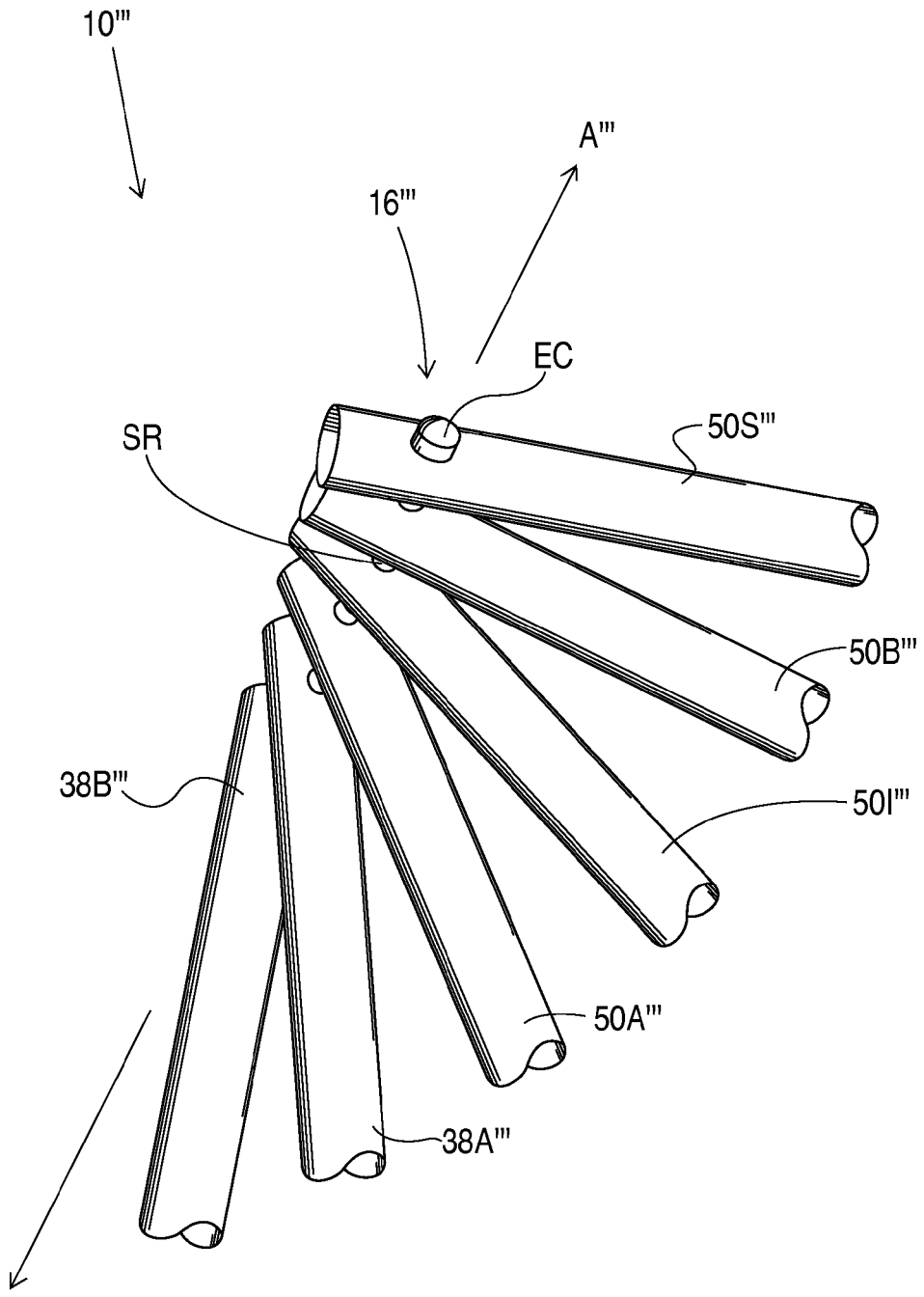
FIG. 24 is a perspective view of a junction assembly of an alternative embodiment of a portable barrier of the present disclosure.

In another alternative embodiment (see FIG. 24), the portable barrier 10''' is modified to include an alternative junction assembly 16''' that consists of a steel rod SR that defines an axis A''' and a pair of end caps EC (only one is shown in FIG. 24). The legs 38A''', 38B''' and the arms 50A''', 50I''', 50B''', 50S''' each includes a through-hole in an end portion thereof through which the steel rod SR extends to couple all the legs and arms together and support the legs/arms while the portable barrier 10''' is positioned in its operative position. One end cap EC is secured to the steel rod SR on each side of the group of legs/arms (see, e.g., FIG. 24). Note that in this alternative embodiment of the portable barrier 10''', the arms possess the same diameter as the legs. However, it should be appreciated that alternatively, the arms may possess a smaller diameter than the legs. In all other aspects of its configuration and operation, the portable barrier 10''' would be identical to the portable barrier 10 of FIG. 1. With the portable barrier 10''' so configured, a line defined by the axis A''' of the steel rod SR is positioned to extend through an access opening (similar to access opening OP discussed below) of the portable barrier 10'''.

Figure 25:
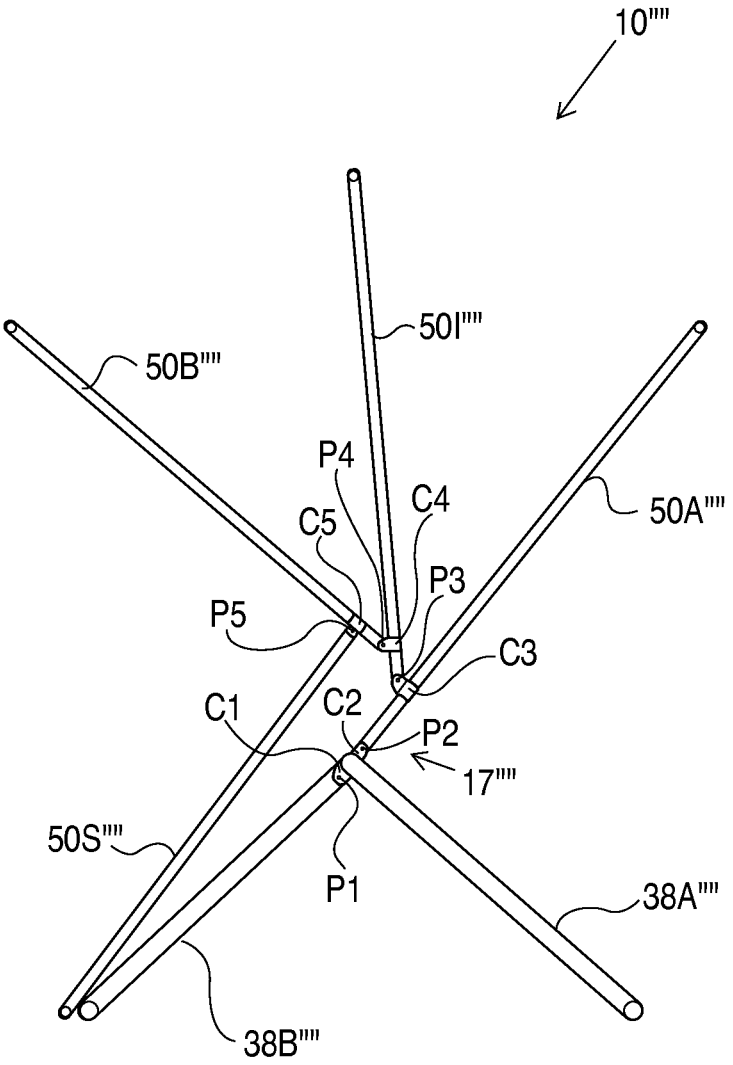
FIG. 25 is a front elevational view of a framework of another alternative embodiment of a portable barrier of the present disclosure showing the framework positioned when the portable barrier is fully deployed in its protection mode of operation.

In yet another alternative embodiment (see FIG. 25), the configuration of the support 17'''' may be modified so that it is not generally U-shaped, but rather linearly shaped. The support 17'''' is integrally formed with the leg 38A'''' and extends rearwardly in relation to the view shown in FIG. 25. The linear shaped support 17'''' has brackets C1, C2 secured to it. The bracket C1 supports a pin P1 about which the leg 38B'''' is pivotably secured. Similarly, the bracket C2 supports a pin P2 about which the arm 50A'''' is pivotably secured. The arm 50A'''' has a bracket C3 secured around it. The bracket C3 supports a pin P3 about which the arm 50I'''' is pivotably secured. Similarly, the arm 50I'''' has a bracket C4 secured around it, and the bracket C4 supports a pin P4 about which the arm 50B'''' is pivotably secured. Further, the arm 50B'''' has a bracket C5 secured around it, and the bracket C5 supports a pin P5 about which the arm 50S'''' is pivotably secured. In all other aspects of its configuration and operation, the portable barrier 10'''' is identical to the portable barrier 10 of FIG. 1. With the portable barrier 10'''' so configured, (i) a line defined by the pin P1 is positioned to extend through an access opening (similar to access opening OP discussed below) of the portable barrier 10'''', (ii) a line defined by the pin P2 is positioned to extend through the access opening of the portable barrier 10'''', (iii) a line defined by the pin P3 is positioned to extend through the access opening of the portable barrier 10'''', (iv) a line defined by the pin P4 is positioned to extend through the access opening of the portable barrier 10'''', and (v) a line defined by the pin P5 is positioned to extend through the access opening of the portable barrier 10''''.

The cover assembly 14 further includes a back cover segment 56 that extends between the lateral arm 50A and the intermediate arm 50N, and another back cover segment 58 that extends between the intermediate arm 50N and the lateral arm 50B as shown in FIG. 3. The back cover segments 56, 58 are attached to the arms 50A, 50B, 50N by fasteners such as screws or rivets (not shown). The same manner of securing the flooring 40 and the back cover segment 44 with fasteners 42 to the legs 38 is used to secure the back cover segments 56, 58 to the arms 50A, 50B, 50N. The back cover segments 56, 58 are made from the same material as the covering 52. It should be appreciated that the back cover segment 56, 58 and the covering 52 are collectively made from a single piece of material that is fastened to the arms 50A, 50B, 50N with fasteners.

In order to reduce the visual prominence of the junction assembly 16 while the portable barrier 10 is in its expanded configuration, a segment 61 of material is attached to a front side of the back cover segments 56, 58 by sewing or stitching as shown in FIG. 5. Similarly, another segment 63 of material (shown in phantom) is attached to a rear side of the back cover segments 56, 58 by sewing as shown in FIG. 3. The segments 61, 63 of material are made from the same material as the back cover segments 56, 58.

Limiters or Side Screens

The limiter or side screen 19 is connected to the lateral arm 50A and the lateral leg 38A, while the limiter or side screen 20 is connected to the lateral arm 50B and the supplemental arm 50S. Both the side screens 19, 20 are configured to be moved from an expanded configuration as shown in FIGS. 1-5 to a collapsed configuration as shown in FIGS. 6-7. In its expanded configuration, the side screen 19 extends from the lateral arm 50A to the lateral leg 38A. The side screen 19 is connected to a back cover segment 60 that also extends between the lateral arm 50A to the lateral leg 38A. The back cover segment 60 is made from the same material as the side screen 19. It should be appreciated that the back cover segment 60 and the side screen 19 are collectively made from a single piece of material that is fastened to the lateral arm 50A and the lateral leg 38A.

Similarly, in its expanded configuration (see FIG. 1), the side screen 20 extends from the lateral arm 50B to the supplemental arm 50S. The side screen 20 is connected to a back cover segment 62 that also extends between the lateral arm 50B to the supplemental arm 50S. The back cover segment 62 is made from the same material as the side screen 20. It should be appreciated that the back cover segment 62 and the side screen 20 are collectively made from a single piece of material that is fastened to the lateral arm 50B and the supplemental arm 50S.

It should be appreciated that the side screen 19 is attached to the lateral leg 38A and the lateral arm 50A so that the extent of movement between the lateral leg 38A and the lateral arm 50A is limited. More specifically, the lateral leg 38A is allowed to move in relation to the lateral arm 50A from the collapsed arrangement of the portable barrier 10 shown in FIG. 7 to the expanded arrangement of the portable barrier 10 shown in FIG. 1. Similarly, the side screen 20 is attached to the lateral arm 50B and the supplemental arm 50S so that the extent of movement between the lateral leg 38B and the supplemental arm 50S is limited. More specifically, the lateral arm 50B is allowed to move in relation to the supplemental arm 50S from the collapsed arrangement of the portable barrier 10 shown in FIG. 7 to the expanded arrangement of the portable barrier 10 shown in FIG. 1.

In the final stage of moving the portable barrier 10 from its collapsed arrangement and to expanded arrangement, the supplemental arm 50S is removably secured in relation to the lateral leg 38B. In particular, the supplemental arm 50S is secured in relation to the lateral leg 38B via a hook and loop type connector such as Velcro®. To achieve this functionality, the supplemental arm 50S has a strip of hook-type connector material H (see FIG. 11) fixed in relation to the arm 50S by having the connector material H attached to a sleeve of material that is secured around the supplemental arm 50S. Further, the lateral leg 38B has a strip of loop-type connector material L (see FIG. 11) fixed in relation to the leg 38B by having the connector material L attached to a sleeve of material that is secured around the lateral leg 38B. To removably secure the supplemental arm 50S to the lateral leg 38B, the connector material H is brought into contact with the connector material L so as to achieve fixation therebetween as is well known to one of ordinary skill in the art. In order to supplement the above-described fixation of the supplemental arm 50S in relation to the lateral leg 38B when the portable barrier 10 is in its expanded or deployed configuration (see FIG. 1), a small strap of loop-type connector material (not shown) is secured to the underside of the flooring 40. A user then advances the strap around the supplemental arm 50S and through a small opening (not shown) defined in the side screen 20 adjacent to the arm 50S and into contact with a strip of hook-type connector material (not shown) which is secured to an upper side of the flooring 40.

It should be appreciated that the back cover segment 56, 58, 60, 62, the side screens 19, 20, and the covering 52 are collectively made from a single sheet of material that is fastened to the arms 50 and lateral leg 38A with fasteners in a manner similar to that described above.

Side Opening Covers

Figure 12:
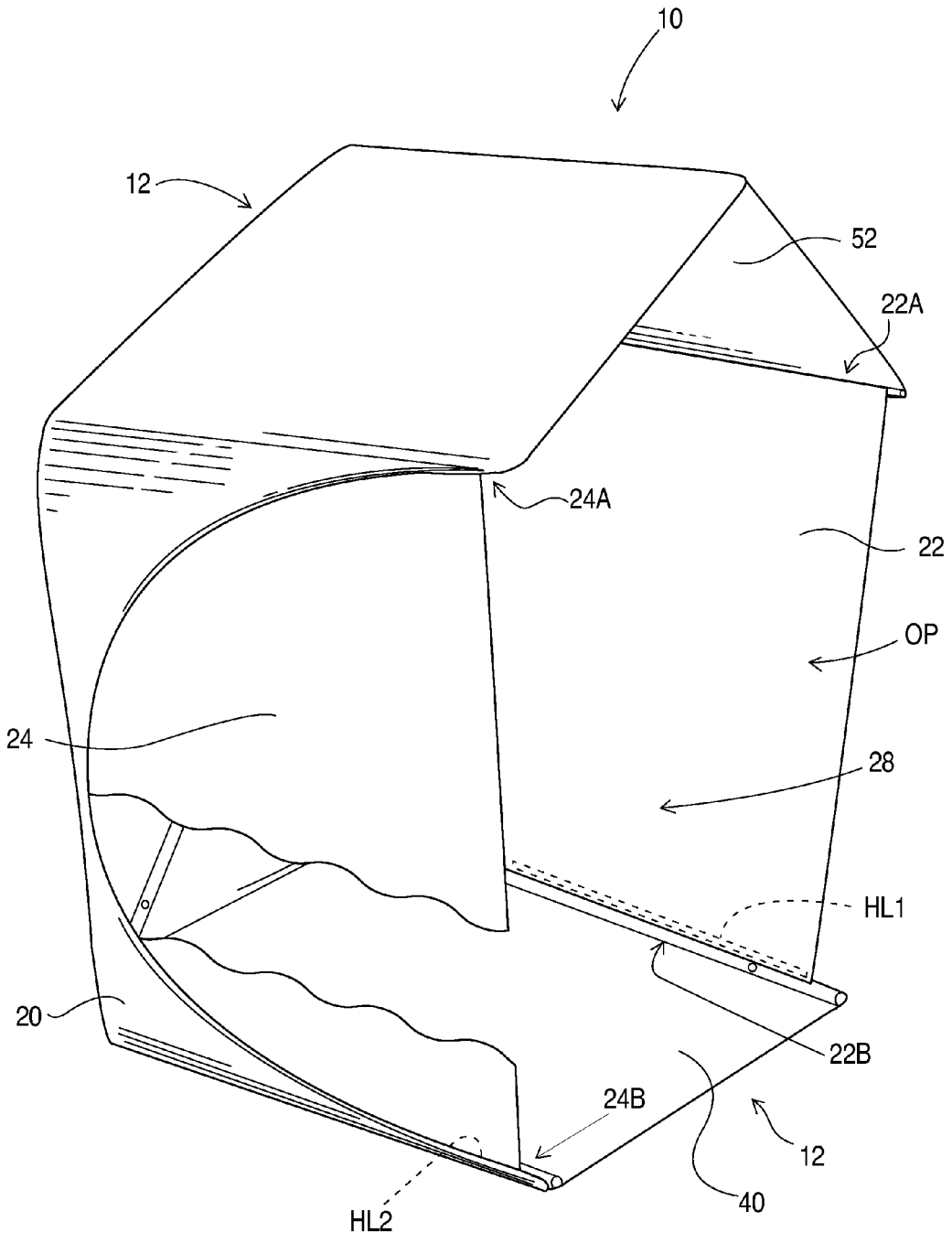
FIG. 12 is a perspective view of the portable barrier of the present disclosure, with the portable barrier shown fully deployed in its protection mode of operation, and further showing both its side opening covers deployed.

As shown in FIGS. 1, 12, and 20, the portable barrier 10 further includes a side opening cover 22 and another side opening cover 24. An upper edge portion 22A of the side opening cover 22 is permanently attached to one side of the covering 52 via a sewing operation, while a lower edge portion 22B of the side opening cover 22 is removably attachable to a lower edge portion of the side screen 19 via a hook and loop type connector HL1 such as Velcro (see FIG. 12 in which connector HL1 is shown in phantom). In particular, the lower edge portion 22B of the side opening cover 22 possesses a strip of hook-type connector material that faces the side screen 19, while the lower edge portion of the side screen 19 possesses a strip of loop-type connector material that faces the side opening cover 22. The side screen 19 is configured to be moved from a collapsed or rolled up configuration as shown in FIG. 1 to an expanded or planar configuration as shown in FIG. 12. In its expanded configuration the side screen 19 extends from the lateral arm 50A to the lateral leg 38A, while in its collapsed configuration the side screen 19 is rolled up and stowed adjacent to the covering 52 via hook and loop type connector straps S.

Similarly, an upper edge portion 24A of the side opening cover 24 is permanently attached to the other side of the covering 52 via a sewing operation, while a lower edge portion 24B of the side opening cover 24 is removably attachable to a lower edge portion of the side screen 20 via a hook and loop type connector HL2 such as Velcro (see FIG. 12). In particular, the lower edge portion 24B of the side opening cover 24 possesses a strip of hook-type connector material that faces the side screen 20, while the lower edge portion of the side screen 20 possesses a strip of loop-type connector material that faces the side opening cover 24. The side screen 20 is configured to be moved from a collapsed or rolled up configuration as shown in FIG. 20 to an expanded or planar configuration as shown in FIG. 12. In its expanded configuration the side screen 20 extends from the lateral arm 50B to near the lateral leg 38B, while in its collapsed configuration the side screen 20 is rolled up and stowed adjacent to the covering 52 via hook and loop type connector straps (not shown).

It should be appreciated that when the portable barrier 10 is positioned in the protection mode, the side opening cover 22 is movable between (i) an extended configuration in which the side opening cover 22 is positioned to cover at least a portion of the side opening 21 (see, e.g., FIG. 12), and (ii) a retracted configuration in which the side opening cover 22 is spaced apart from the side opening 21 (see, e.g., FIGS. 1 and 20). Similarly, when the portable barrier 10 is positioned in the protection mode, the side opening cover 24 is movable between (i) an extended configuration in which the side opening cover 24 is positioned to cover at least a portion of the side opening 23 (see, e.g., FIG. 12), and (ii) a retracted configuration in which the side opening cover 24 is spaced apart from the side opening 23 (see, e.g., FIGS. 1 and 20).

Figure 19:
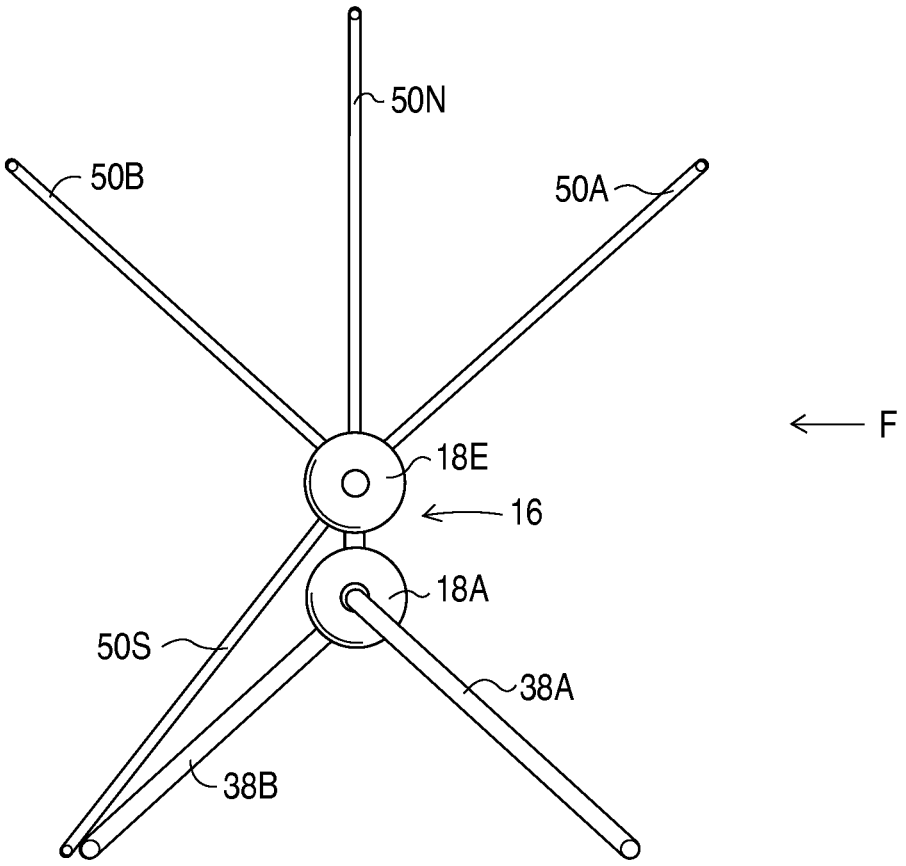
FIG. 19 is a front elevational view of the framework of the portable barrier of FIG. 1 when the portable barrier is fully deployed in its protection mode of operation as shown in FIG. 1.
Figure 19A:
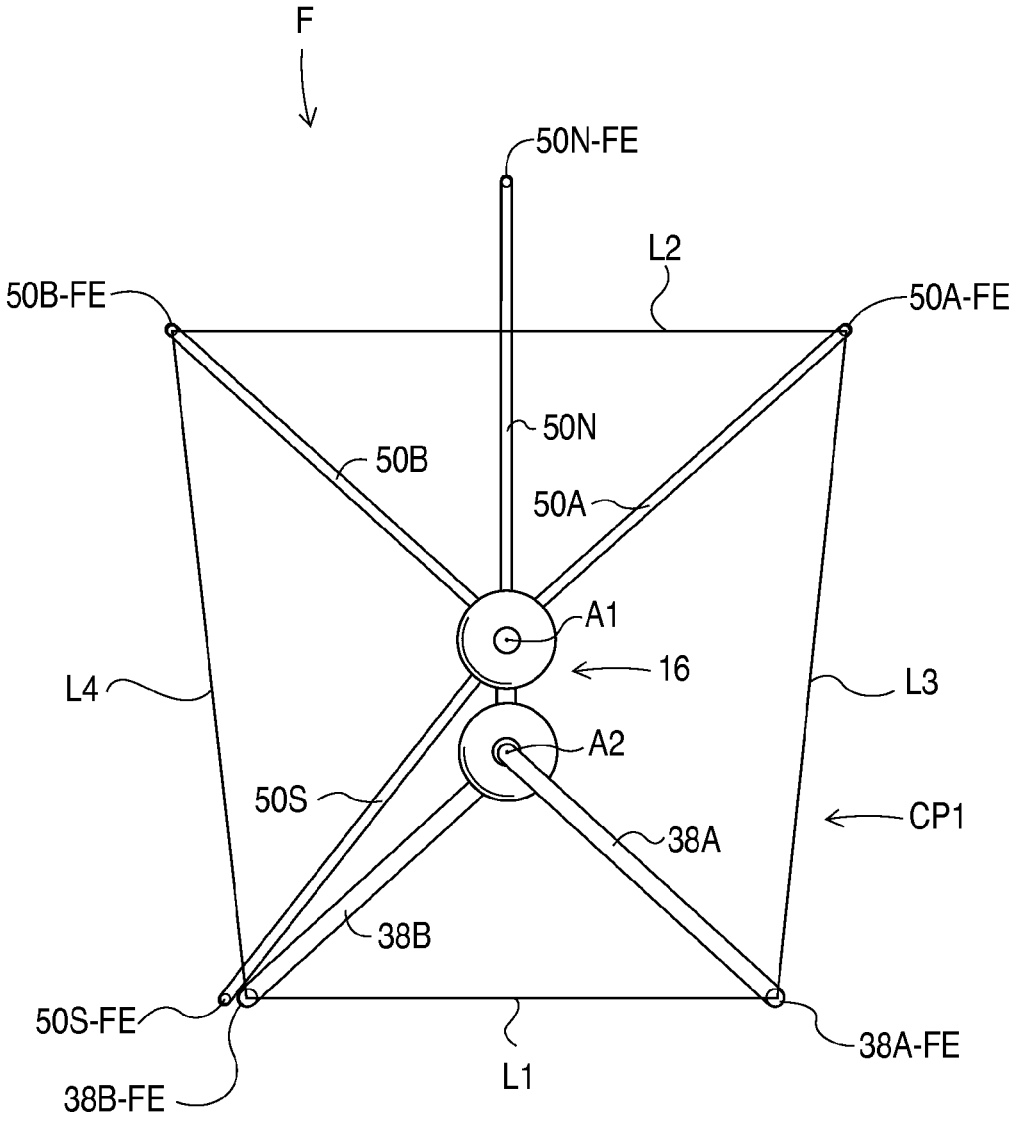
FIG. 19A is a view similar to FIG. 19, but depicting other structural characteristics of the portable barrier.

FIG. 19A Discussion

FIG. 19A is a front elevational view of a framework F of the portable barrier 10 when the portable barrier is fully deployed in its protection mode of operation as shown in FIG. 1. The framework F includes the pedestal assembly 12 without the limiter or flooring 40, the cover assembly 14 without the covering 52, and the junction assembly 16. FIG. 19A provides assistance in understanding certain structural characteristics of the portable barrier 10.

When the portable barrier 10 is positioned in the protection mode (see FIGS. 1, 12, 19A, and 20), the following is true: (i) a line L1 is defined between the free leg end 38A-FE and the free leg end 38B-FE, (ii) a line L2 is defined between the free arm end 50A-FE and the free arm end 50B-FE, (iii) a line L3 is defined between the free leg end 38A-FE and the free arm end 50A-FE, and (iv) a line L4 is defined between the free leg end 38B-FE and the free arm end 50B-FE. The lines L1, L2, L3, and L4 define a closed path CP1 as shown in FIG. 19A. Each of the lateral arms 50A, 50B, the intermediate arm 50N, and the supplemental arm 50S pivots about the axis A1 during movement of the portable barrier 10 between the protection mode (FIG. 1) and the storage mode (FIG. 7). Further, the lateral leg 38B pivots about the axis A2 during movement of the portable barrier 10 between the protection mode and the storage mode. The line defined by the first axis A1 extends through the closed path CP1. For example, if the closed path CP1 lies in a plane (i.e. possess a planar configuration), then the line defined by the first axis A1 intersects a space that is bounded by the closed path CP1. It should be noted, however, that the closed path CP1 may or may not lie in a plane. The line defined by the second axis A2 also extends through the closed path CP1.

Figure 19B:
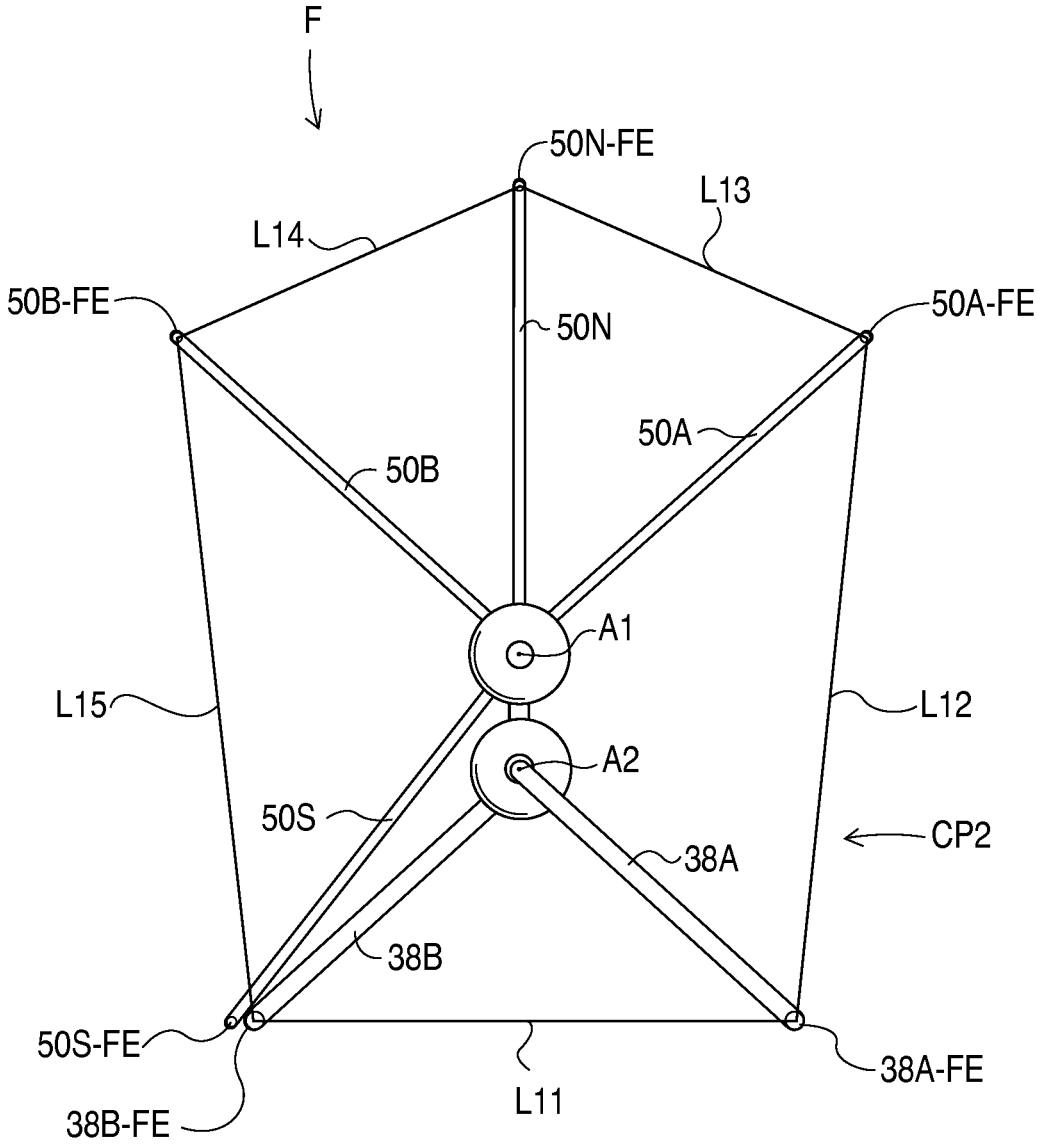
FIG. 19B is a view similar to FIG. 19, but depicting yet further structural characteristics of the portable barrier.

FIG. 19B Discussion

FIG. 19B is also a front elevational view of a framework F of the portable barrier 10 when the portable barrier is fully deployed in its protection mode of operation as shown in FIG. 1. FIG. 19B provides assistance in understanding further structural characteristics of the portable barrier 10.

When the portable barrier 10 is positioned in the protection mode (see FIGS. 1, 12, 19A, and 20), the following is true: (i) a line L11 is defined between the free leg end 38A-FE and the free leg end 38B-FE, (ii) a line L12 is defined between the free leg end 38A-FE and the free arm end 50A-FE, (iii) a line L13 is defined between the free arm end 50A-FE and the free arm end 50N-FE, (iv) a line L14 is defined between the free arm end 50N-FE and the free arm end 50B-FE, and (v) a line L15 is defined between the free arm end 50B-FE and the free leg end 38B-FE. The lines L11, L12, L13, L14, and L15 define a closed path CP2 as shown in FIG. 19B. Each of the lateral arms 50A, 50B, the intermediate arm 50N, and the supplemental arm 50S pivots about the axis A1 during movement of the portable barrier 10 between the protection mode (FIG. 1) and the storage mode (FIG. 7). Further, the lateral leg 38B pivots about the axis A2 during movement of the portable barrier 10 between the protection mode and the storage mode. The line defined by the first axis A1 extends through the closed path CP2. For example, if the closed path CP2 lies in a plane (i.e. possess a planar configuration), then the line defined by the first axis A1 intersects a space that is bounded by the closed path CP2. It should be noted, however, that the closed path CP2 may or may not lie in a plane. The line defined by the second axis A2 also extends through the closed path CP2.

Figure 20A:
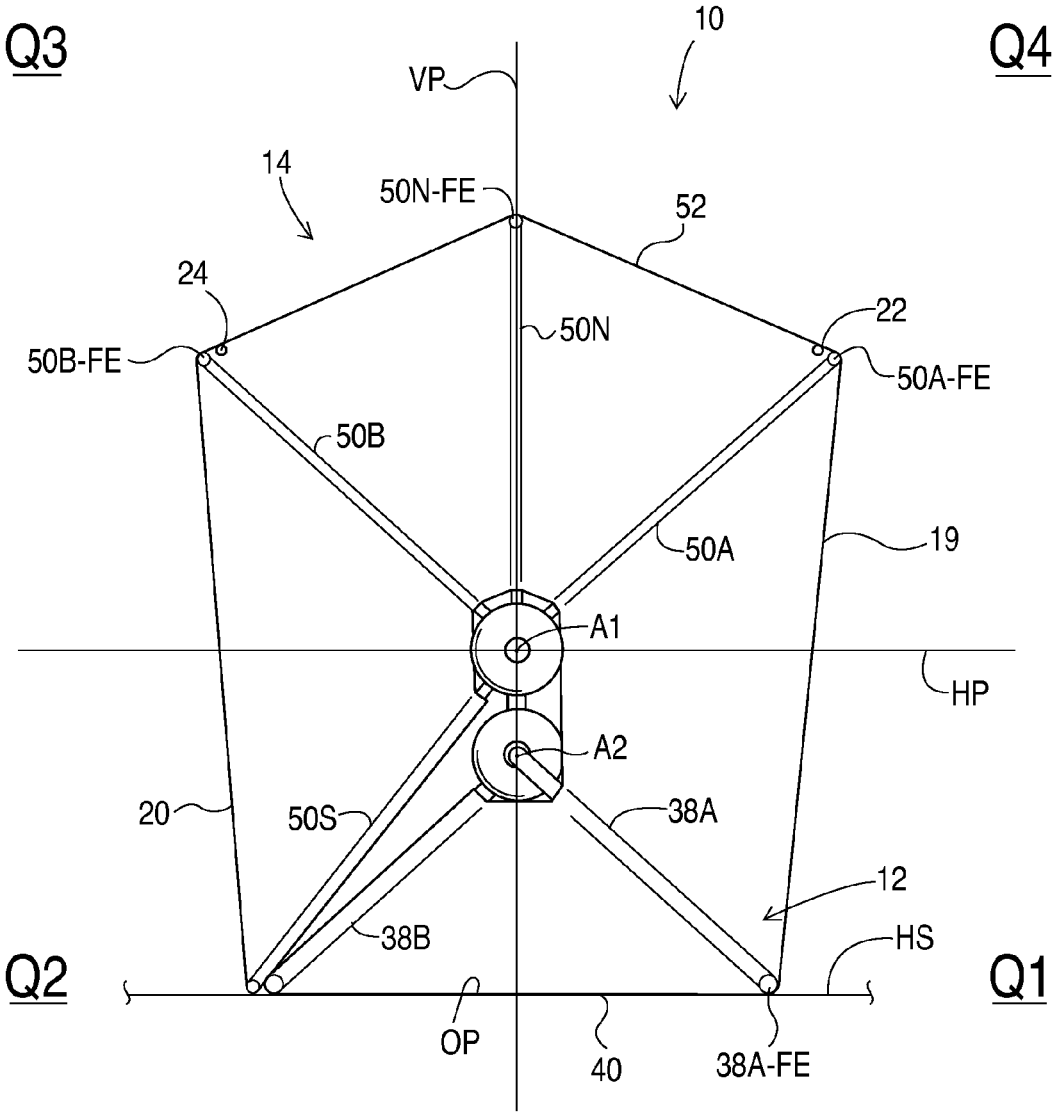
FIG. 20A is a view similar to FIG. 20, but depicting other structural characteristics of the portable barrier.
Figure 21:
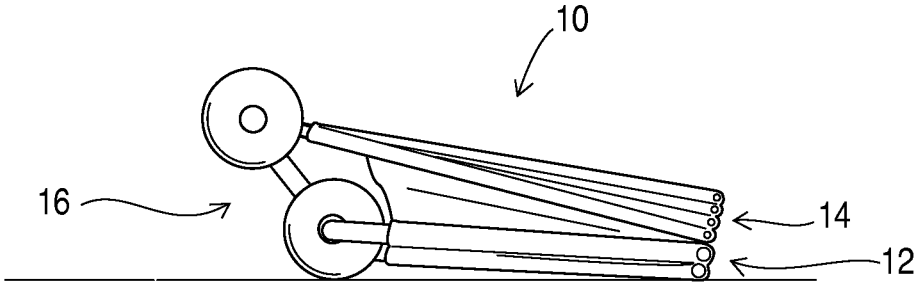
FIG. 21 is a front elevational view of the portable barrier of FIG. 7 when the portable barrier is in its protection storage of operation.
Figure 21A:
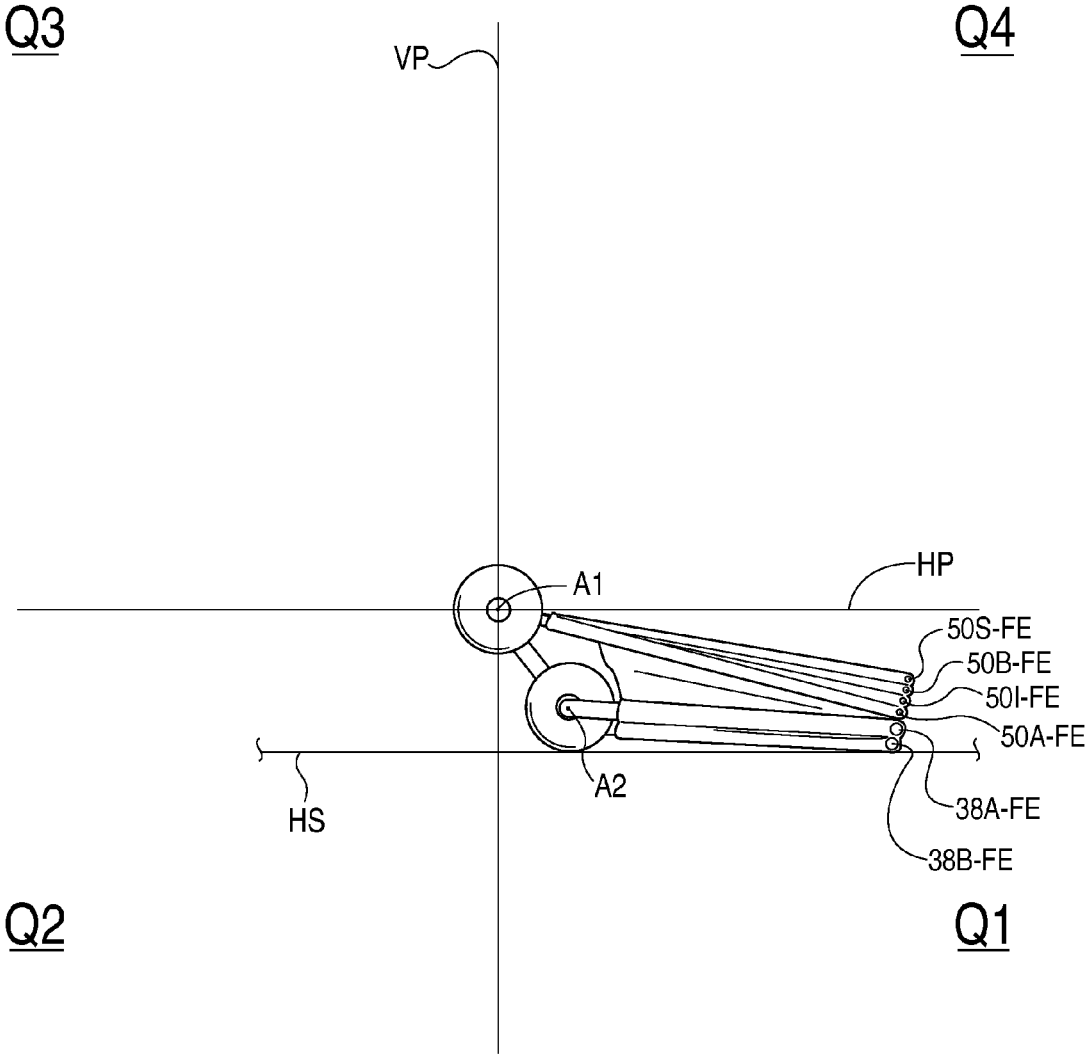
FIG. 21A is a view similar to FIG. 21, but depicting other structural characteristics of the portable barrier.

FIGS. 20A and 21A Discussion

FIG. 20A is a front elevational view of the portable barrier 10 when the portable barrier is fully deployed in its protection mode of operation as shown in FIG. 1. FIG. 20A provides assistance in understanding additional structural characteristics of the portable barrier 10.

Turning to FIG. 20A, there is shown a vertical plane VP that intersects a horizontal plane HP in a perpendicular manner to define a first quadrant Q1, a second quadrant Q2, a third quadrant Q3, and a fourth quadrant Q4. The vertical plane VP and the horizontal plane HP may be superimposed on the portable barrier 10 so that a line defined by the intersection of the planes VP and HP lies on the axis A1 as shown in FIGS. 20A and 21A. The portable barrier 10 is further configured so that, when the vertical plane VP and the horizontal plane HP are superimposed on the portable barrier 10 while the portable barrier is positioned in the protection mode and the pedestal assembly 12 is supported on the horizontal surface HS, (i) the free leg end 38A-FE is positioned in the first quadrant Q1, (ii) the free leg end 38B-FE is positioned in the second quadrant Q2, (iii) the free arm end 50A-FE is positioned in the third quadrant Q3, (iv) the free arm end 50B-FE is positioned in the fourth quadrant Q4, (v) the limiter or flooring 40 extends from the first quadrant Q1 to the second quadrant Q2 through the vertical plane VP, and (vi) the covering 52 extends from the third quadrant Q3 to the fourth quadrant Q4 through the vertical plane VP.

FIG. 21A shows a front elevational view of the portable barrier 10 when the portable barrier is in its storage of operation as shown in FIG. 7. FIG. 21A provides assistance in understanding further structural characteristics of the portable barrier 10.

The portable barrier 10 is further configured so that, when the vertical plane VP and the horizontal plane HP are superimposed on the portable barrier while the portable barrier is positioned in the storage mode and the pedestal assembly is supported on the horizontal surface HS, each of the free leg end 38A-FE, the free leg end 38B-FE, the free arm end 50A-FE, and the free arm end 50B-FE is (i) positioned in the first quadrant Q1, and (ii) spaced apart from each of the second quadrant Q2, the third quadrant Q3, and the fourth quadrant Q4. In addition, the portable barrier 10 is configured so that, when the vertical plane VP and the horizontal plane HP are superimposed on the portable barrier while the portable barrier is positioned in the storage mode and the pedestal assembly is supported on the horizontal surface HS, each of the limiter or flooring 40 and the covering 52 is further (i) positioned in the first quadrant Q1, and (ii) spaced apart from each of the second quadrant Q2, the third quadrant Q3, and the fourth quadrant Q4.

It should also be appreciated that the portable barrier 10 is further configured so that, when the vertical plane VP and the horizontal plane HP are superimposed on the portable barrier while the portable barrier is positioned in the storage mode and the pedestal assembly 12 is supported on the horizontal surface HS, the junction assembly 16 is (i) partially positioned in the first quadrant Q1, (ii) partially positioned in the second quadrant Q2, (iii) partially positioned in the third quadrant Q3, and (vi) partially positioned in the fourth quadrant Q4. Also, the portable barrier 10 is further configured so that, when the vertical plane VP and the horizontal plane HP are superimposed on the portable barrier while the portable barrier is positioned in the storage mode and the pedestal assembly 12 is supported on the horizontal surface HS, the horizontal surface HS extends from the first quadrant Q1 to the second quadrant Q2 through the vertical plane VP as shown in FIG. 21A. It should additionally be noted that the lateral leg 38B pivots about the axis A2 during movement of the portable barrier 10 from the protection mode to the storage mode, and the axis A2 is positioned in the first quadrant Q1 as shown in FIGS. 20A and 21A.

Portable Barrier 10'

Figure 2:
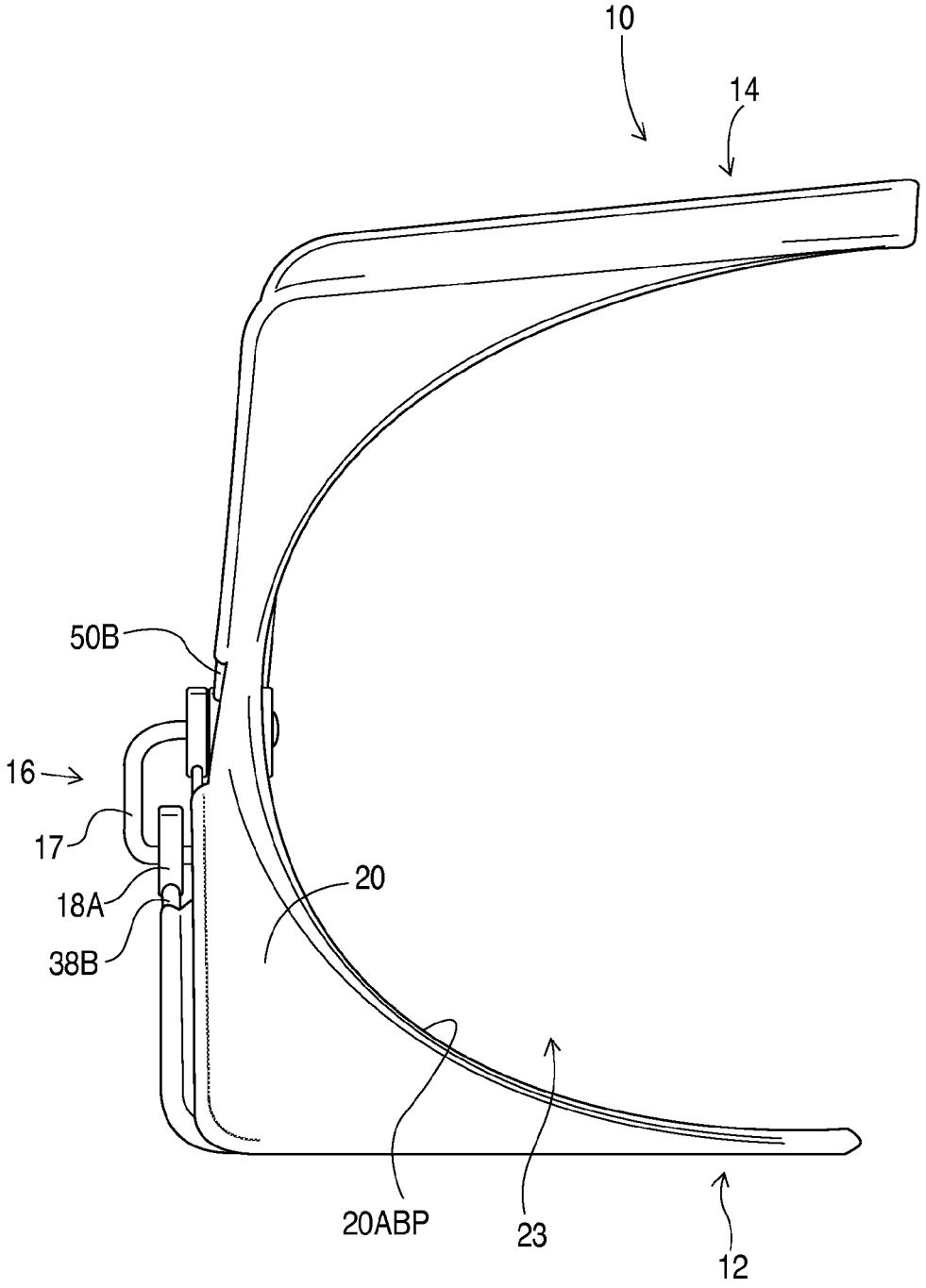
FIG. 2 is a right side elevational view of the portable barrier of FIG. 1, with the portable barrier shown in its protection mode of operation.
Figure 22:
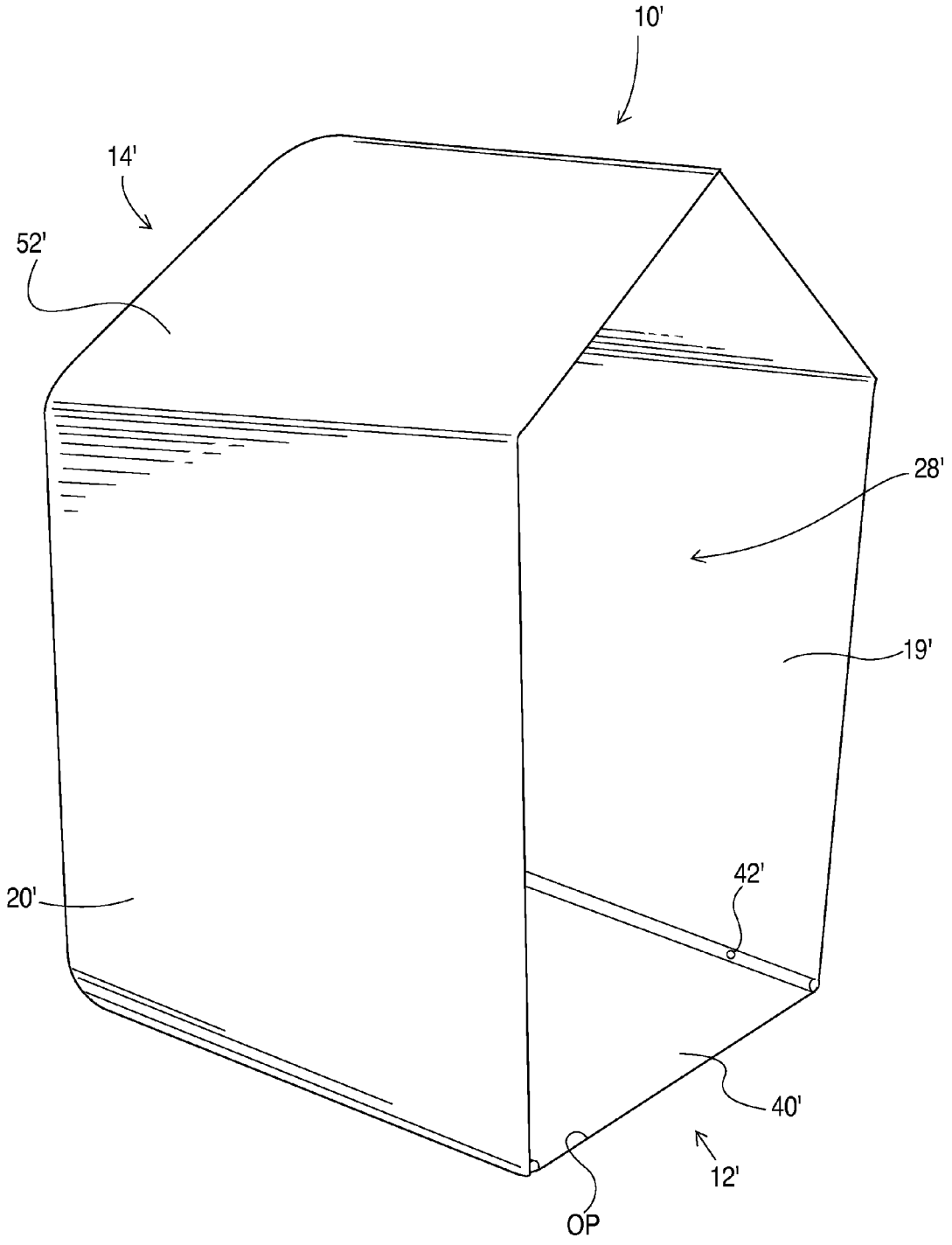
FIG. 22 is a perspective view of an alternative embodiment of the portable barrier of the present disclosure, with the portable barrier shown in its protection mode of operation.

Another embodiment of the portable barrier (i.e. portable barrier 10') is shown in detail in FIG. 22. The portable barrier 10' has the exact same configuration as the portable barrier 10 and operates in the exact same manner as the portable barrier 10 with the following exceptions. Firstly, the side screens 19', 20' of the portable barrier 10' do not possess respective side openings such as side openings 21, 23 as shown in FIGS. 1, 2, and 4. Further, since there are no side openings, the portable barrier 10' does not include side opening covers such as side opening covers 22, 24 as shown in FIG. 12. Since the portable barrier 10' has a very similar construction in relation to the portable barrier 10, the reference numbers used to identify components in FIGS. 1-21 are also applicable to the portable barrier 10' with the exception that a prime symbol (') is used to denote components of the portable barrier 10' in FIG. 22.

Portable Barrier 10"

Figure 23:
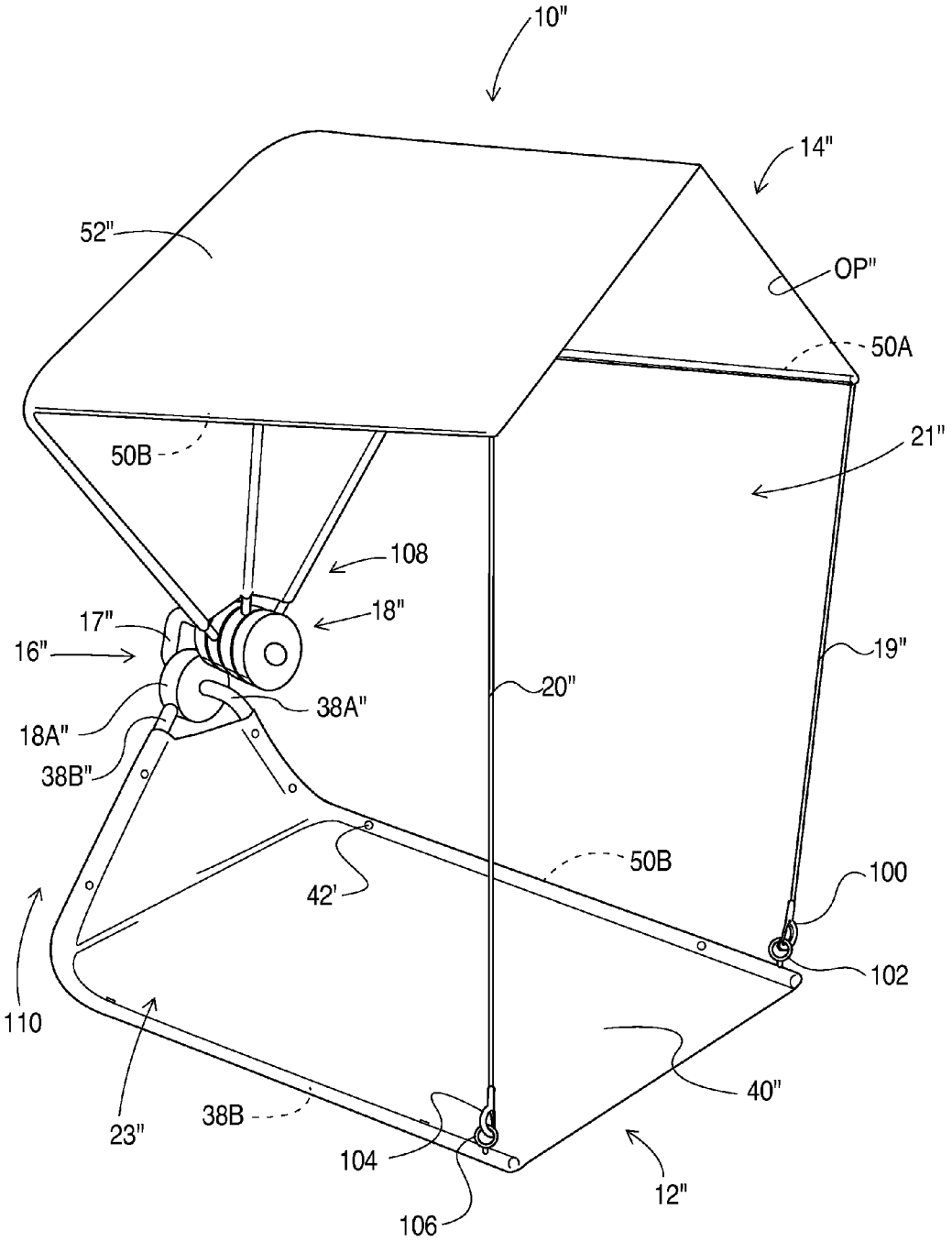
FIG. 23 is a perspective view of another alternative embodiment of the portable barrier of the present disclosure, with the portable barrier shown in its protection mode of operation.

Still another embodiment of the portable barrier (i.e. portable barrier 10") is shown in detail in FIG. 23. The portable barrier 10" has the exact same configuration as the portable barrier 10 and operates in the exact same manner as the portable barrier 10 with the following exceptions. Firstly, the limiters 19", 20" of the portable barrier 10' are straps that extend between the cover assembly 14" and the pedestal assembly 12". In particular, the strap 19" has a first end that is fixed to the lateral arm 50A" and a second end that is removably attachable in relation to the lateral leg 38A". Specifically, the second end of the strap 19" has a snap hook 100 coupled thereto which is removably securable to a ring 102 that is fixed to the lateral leg 38A". Similarly, the strap 20" has a first end that is fixed to the lateral arm 50B" and a second end that is removably attachable in relation to the lateral leg 38B". To this end, the second end of the strap 20" has a snap hook 104 coupled thereto which is removably securable to a ring 106 that is fixed to the lateral leg 38B". While not shown, the portable barrier 10" may also include side opening covers such as side opening covers 22, 24 as shown in FIG. 12 which are configured to cover the side openings 21", 23" of the portable barrier 10". The side opening covers may also be configured to respectively include a rear aspect which covers the rear openings 108, 110 of the portable barrier 10". Since the portable barrier 10' has a very similar construction in comparison to the portable barrier 10, the reference numbers used to identify components in FIGS. 1-21 are also applicable to the portable barrier 10" with the exception that a double prime symbol (") is used to denote components of the portable barrier 10" in FIG. 23.

Operation of Portable Barrier

Figure 8:
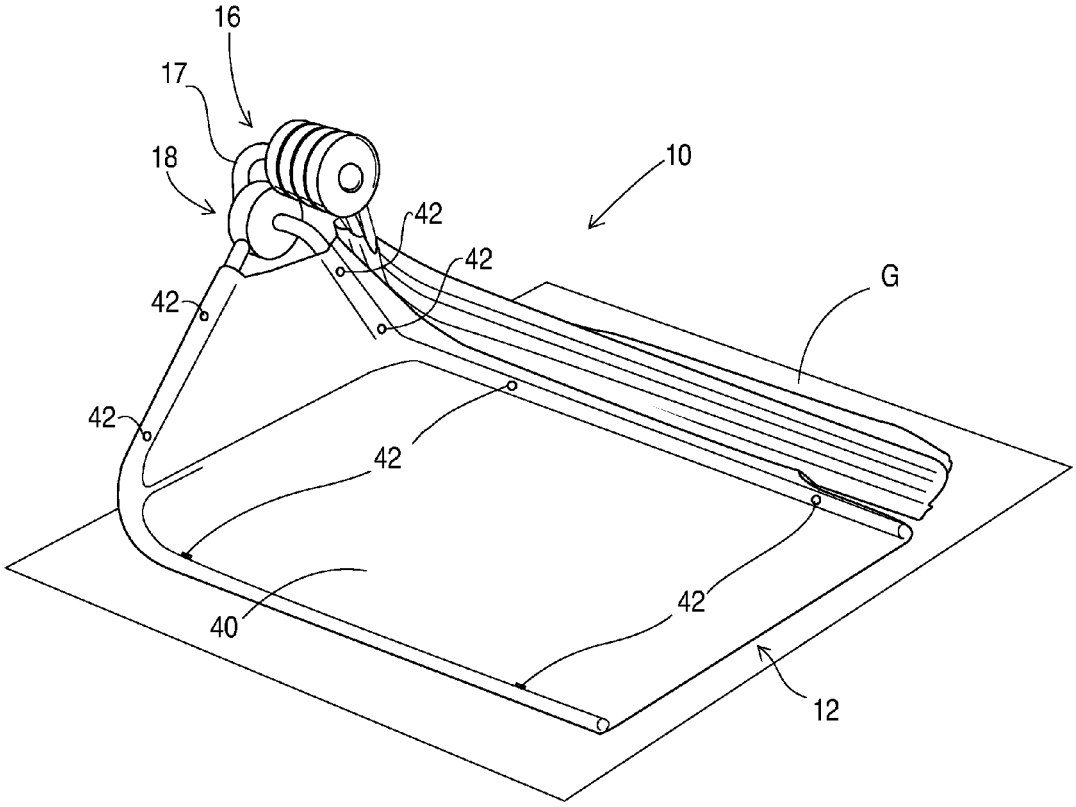
FIGS. 8-11 are perspective views of the portable barrier of FIG. 1 shown at various intermediate stages of being moved from its storage mode to its protection mode.
Figure 9:
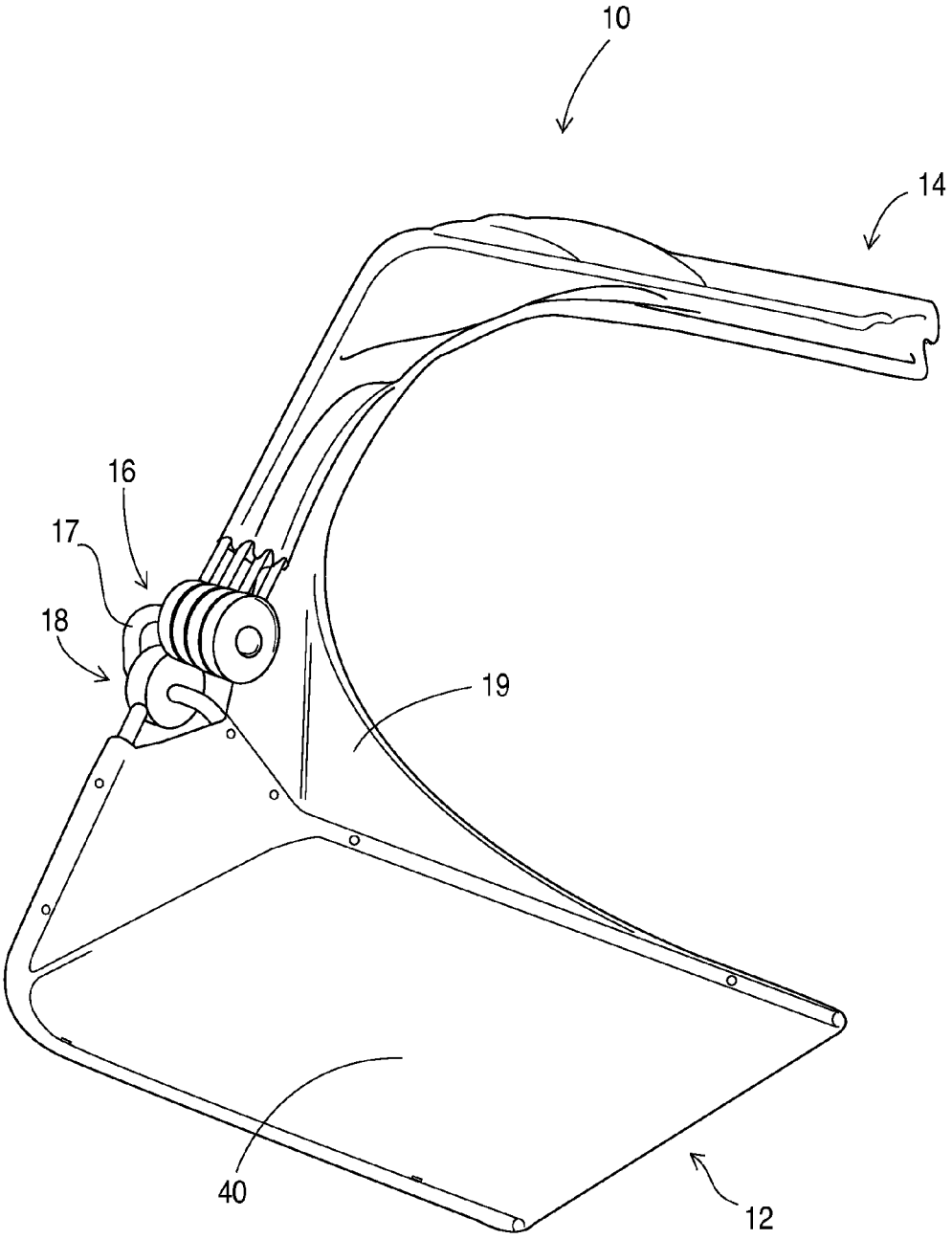
Figure 10:
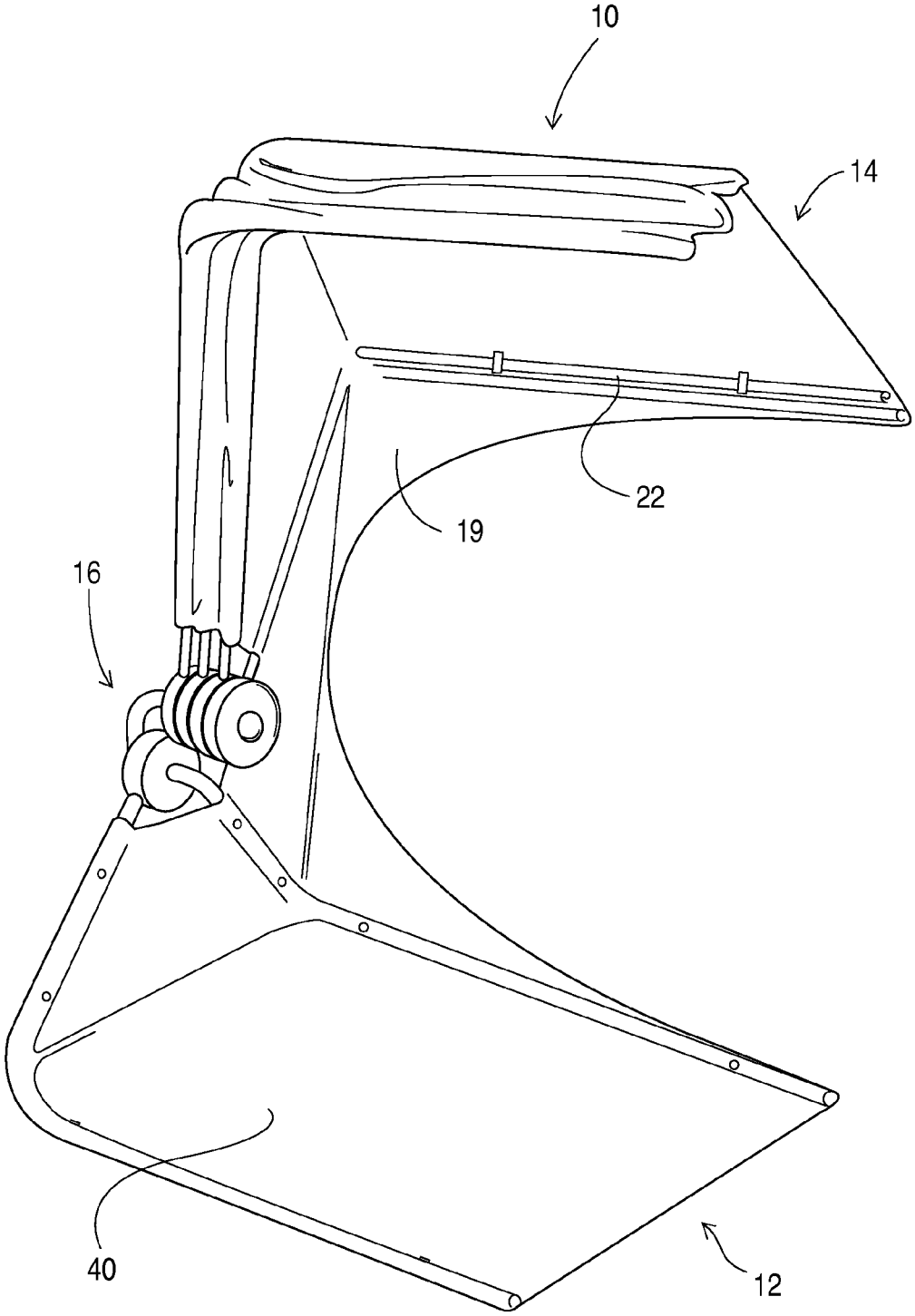
Figure 13:
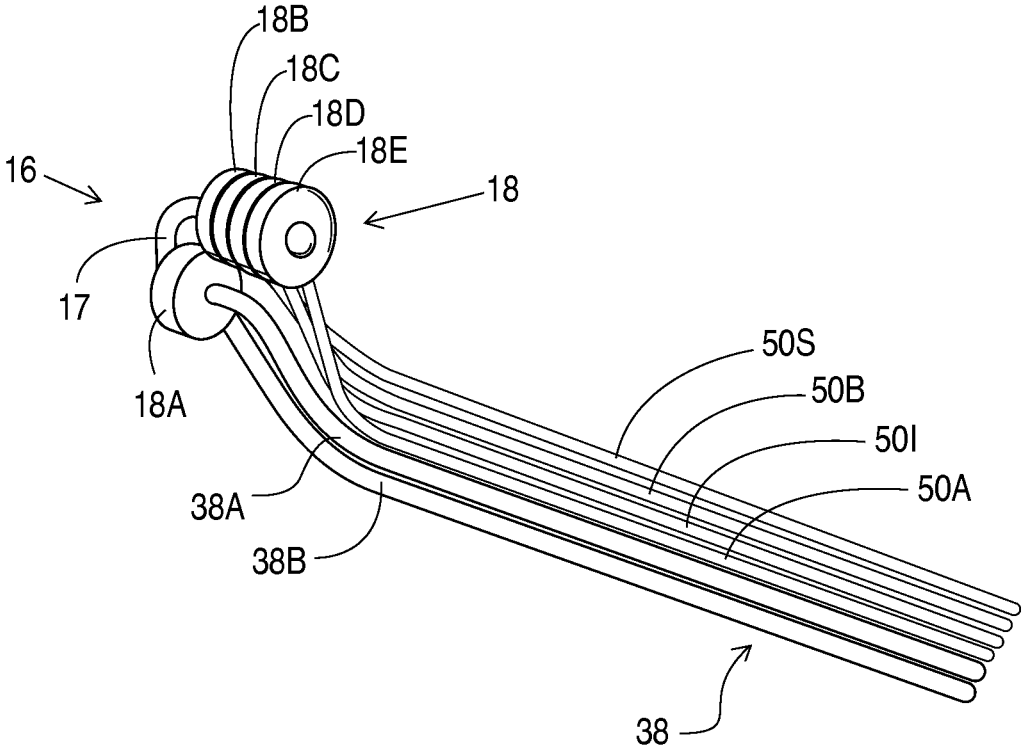
FIG. 13 is a perspective view of the framework of the portable barrier of FIG. 1, with the framework shown when the portable barrier is positioned in its storage mode of operation such as shown in FIG. 7.
Figure 14:
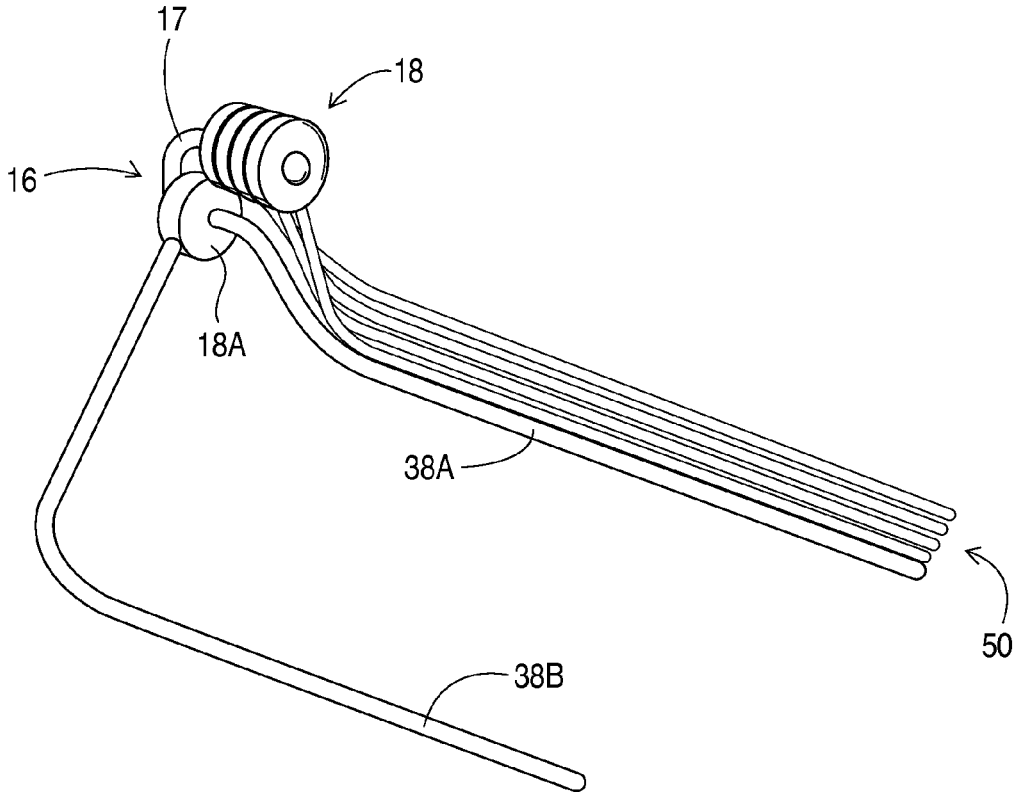
FIG. 14 is perspective view of the framework of the portable barrier when the portable barrier is positioned in its position shown in FIG. 8.
Figure 15:
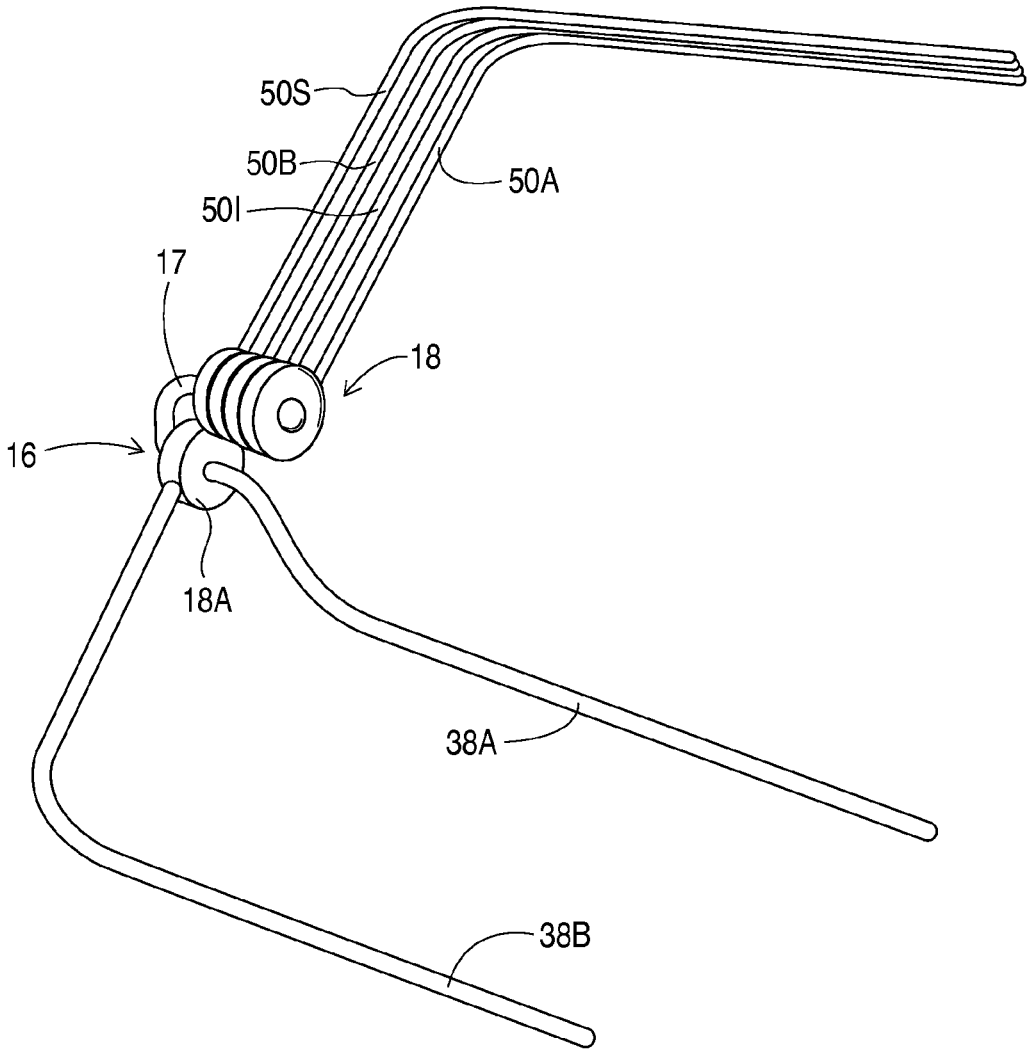
FIG. 15 is perspective view of the framework of the portable barrier when the portable barrier is positioned in its position shown in FIG. 9.
Figure 16:
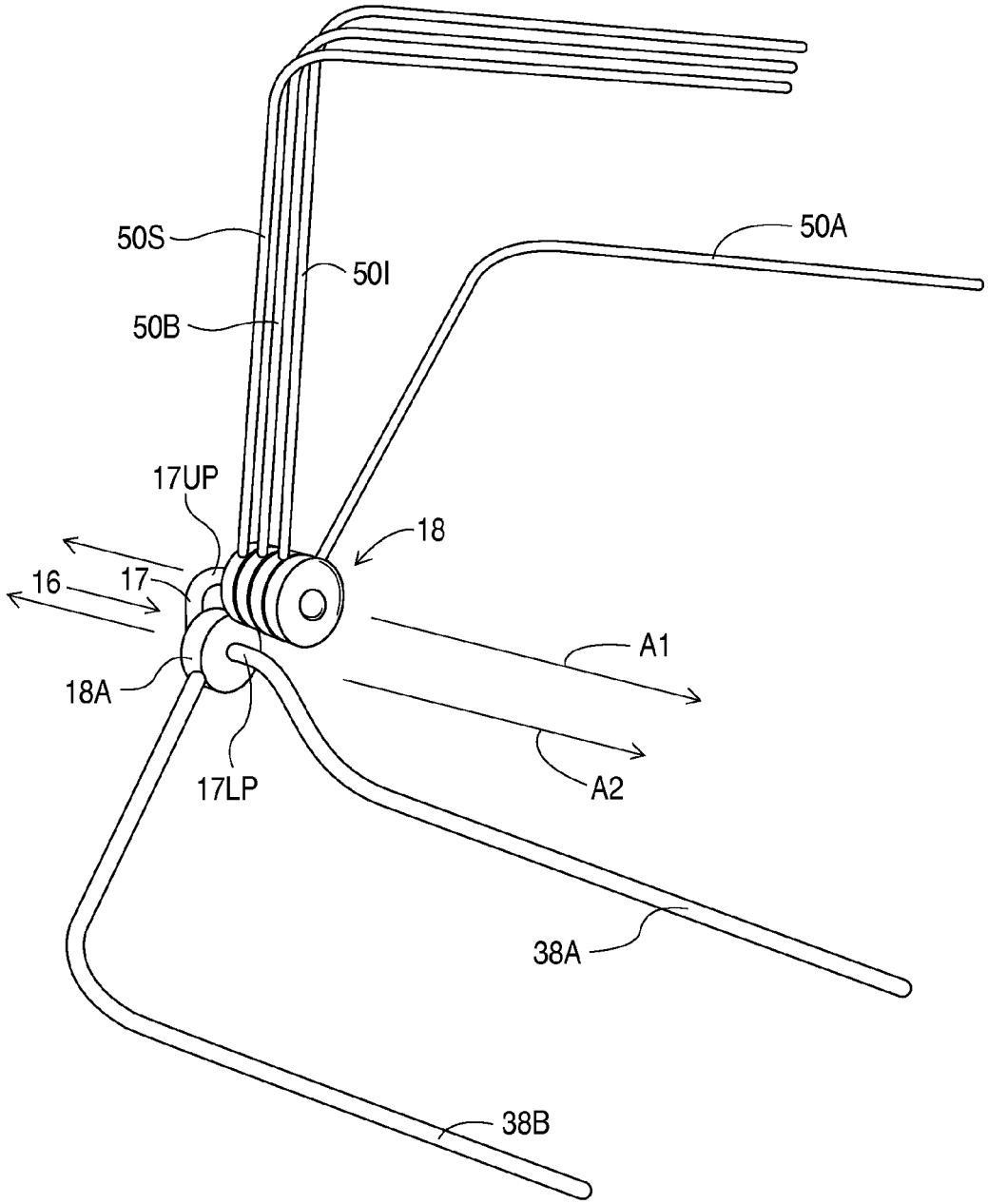
FIG. 16 is perspective view of the framework of the portable barrier when the portable barrier is positioned in its position shown in FIG. 10.
Figure 17:
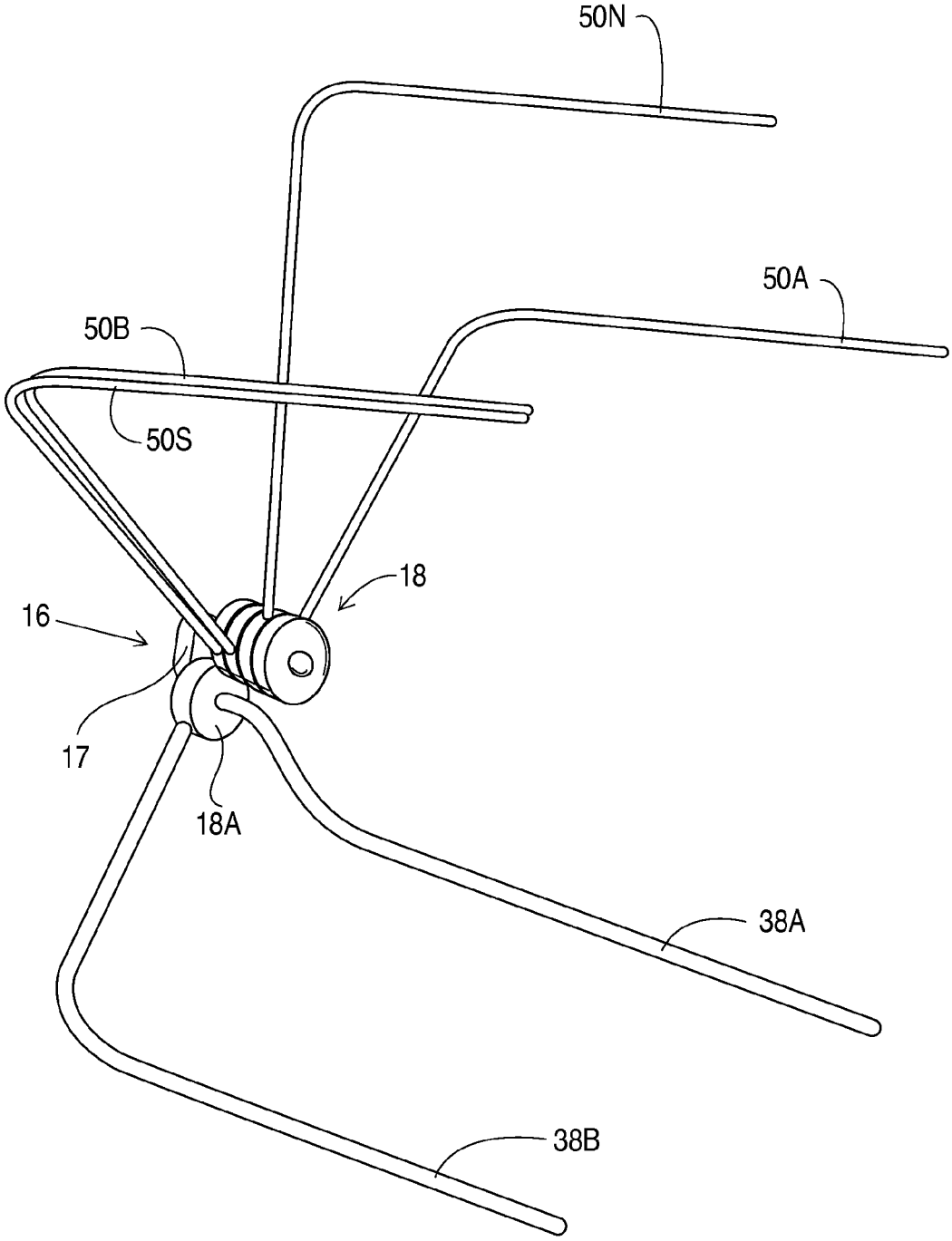
FIG. 17 is perspective view of the framework of the portable barrier when the portable barrier is positioned in its position shown in FIG. 11.

Upon arriving at a use destination such as a sandy beach or near the sideline of a soccer field, a user removes the portable barrier 10 from the carrier bag 30 and places the portable barrier on the ground G. Thereafter, the lateral legs 38A and 38B are moved away from each other from their relative position shown in FIG. 7 to their relative position shown in FIG. 8. (Note that FIGS. 13 and 14 show the relative position of the lateral legs 38A, 38B corresponding to the views of FIGS. 7 and 8 with the flooring removed for clarity of understanding.) In this position the pedestal assembly 12 is supported on the ground G as shown in FIG. 8. Moving of the laterals legs 38A, 38B in such a manner causes the flooring 40 to be deployed. When deployed, the flooring 40 is positioned on the ground G so as to be supported thereby. Then, the arms 50A, 50I, 50B, 50S are moved from their position shown in FIG. 8 to their position shown in FIG. 9. (Note that FIG. 15 shows the position of the arms 50A, 50I, 50B, 50S corresponding to the view of FIG. 9 with the covering and side screens removed for clarity of understanding.) Moving of the arm 50A in such a manner causes the side screen 19 to be deployed. The arms 50I, 50B, 50S are then moved from their position in FIG. 9 to their position in FIG. 10. (Note that FIG. 16 shows the position of the arms 50A, 50I, 50B, 50S corresponding to the view of FIG. 10 with the covering and side screens removed for clarity of understanding.) Thereafter, arms 50B, 50S are moved from their position in FIG. 10 to their position in FIG. 11. (Note that FIG. 17 shows the position of the arms 50A, 50I, 50B, 50S corresponding to the view of FIG. 11 with the covering and side screens removed for clarity of understanding.) Moving of the arms 50A, 50I, 50B away from each other in manner described above causes the covering 52 to be deployed. When deployed, the covering 52 is supported above the ground G. Then, the arm 50S is moved from its position shown in FIG. 11 to its position shown in FIG. 12. (Note that FIG. 18 shows the position of the arms 50A, 50I, 50B, 50S corresponding to the view of FIG. 12 with the covering and side screens removed for clarity of understanding.) Moving of the arm 50S in such a manner causes the side screen 20 to be deployed. Also, moving the arm 50S in such a manner causes the strip of hook-type connector material H (see FIG. 11) to come into contact with the strip of loop-type connector material L so as to achieve fixation therebetween. Then, in order to supplement the above-described fixation of the supplemental arm 50S in relation to the lateral leg 38B, a small strap of loop-type connector material (not shown) that is secured to the underside of the flooring 40 is then advanced around the supplemental arm 50S and through a small opening (not shown) defined in the side screen 20 adjacent to the arm 50S and into contact with a strip of hook-type connector material (not shown) which is secured to an upper side of the flooring 40.

In response to the portable barrier 10 being deployed in such a manner, the occupant space 28 is created. The chair 27 is then advanced into the occupant space 28 through an access opening OP and situated so as to be supported on the flooring 40 as shown in FIG. 5. It should be appreciated that the access opening OP is defined by the separation of the front edge 40FE of the flooring 40 and the front edge 52E of the covering 52 as shown in FIG. 5. The occupant 26 then enters the occupant space 28 through the access opening OP and sits in the chair 27 so as to be protected from exposure to sun, wind, and/or rain by the portable barrier 10. Alternatively, after the occupant space 28 is created by deployment of the portable barrier 10, a chair is not positioned in the occupant space, but rather an occupant enters the occupant space 28 through the access opening OP and sits down, or alternatively, lays down on the flooring 40 whereby the occupant is protected from exposure to sun, wind, and/or rain by the portable barrier 10.

There is a plurality of advantages arising from the various features of each of the embodiments of the portable barrier 10, 10', 10", 10''', 10'''' described herein. It will be noted that alternative embodiments of the portable barrier may not include all of the features described yet still benefit from at least some of the advantages of such features. Those of ordinary skill in the art may readily devise their own implementations of the portable barrier that incorporate one or more of the features of the portable barrier 10, 10', 10", 10''', 10'''' and fall within the spirit and scope of the present invention as defined by the appended claims.

What is claimed is:

1. A method of setting up a portable barrier that includes (i) a junction assembly, (ii) a leg assembly including (A) a first leg having a first strut portion extending from the junction assembly, and a first extension portion that terminates in a first unsupported end, and (B) a second leg having a second strut portion extending from the junction assembly, and a second extension portion that terminates in a second unsupported end, (iii) an arm assembly including (A) a first arm having a third strut portion extending from the junction assembly, and a third extension portion that terminates in a third unsupported end, and (B) a second arm having a fourth strut portion extending from the junction assembly, and a fourth extension portion that terminates in a fourth unsupported end, (iv) a supplemental component having a fifth strut portion extending from the junction assembly, the supplemental component being movable with respect to the second arm, (v) a flooring configured to be moved between a collapsed flooring configuration and an expanded flooring configuration, and (vi) a covering configured to be moved between a collapsed covering configuration and an expanded covering configuration, the method comprising:

(a) moving the first leg and the second leg away from each other to an arrangement in which the first extension portion and the second extension portion are each supported on a substantially horizontal surface;

(b) moving the flooring from the collapsed flooring configuration to the expanded flooring configuration in response to step (a);

(c) moving the first arm and the second arm away from each other;

(d) moving the covering from the collapsed covering configuration to the expanded covering configuration in response to step (c), and (e) securing the supplemental component in fixed relation to the second leg after step (d), wherein, when the flooring is in the expanded flooring configuration and the covering is in the expanded covering configuration, an occupant space is defined between the flooring and the covering, wherein, after step (e): (i) the first strut portion is positioned to extend in a first direction away from the junction assembly and toward the horizontal surface, (ii) the second strut portion is positioned to extend in a second direction away from the junction assembly and toward the horizontal surface, (iii) the third strut portion is positioned to extend in a third direction away from the junction assembly and away from the horizontal surface, (iv) the fourth strut portion is positioned to extend in a fourth direction away from the junction assembly and away from the horizontal surface, and (v) the fifth strut portion is positioned to extend in a fifth direction away from the junction assembly and toward the horizontal surface, and wherein after step (e) and when the portable barrier is viewed in a front elevational view:

(i) the first strut portion is positioned to extend in the first direction away from the junction assembly so as to define a first ray, (ii) the second strut portion is positioned to extend in the second direction away from the junction assembly so as to define a second ray, (iii) the third strut portion is positioned to extend in the third direction away from the junction assembly so as to define a third ray, (iv) the fourth strut portion is positioned to extend in the fourth direction away from the junction assembly so as to define a fourth ray, and (v) the fifth strut portion is positioned to extend in the fifth direction away from the junction assembly so as to define a fifth ray, and (i) the first ray and the second ray diverge, (ii) the first ray and the third ray diverge, (iii) the third ray and the fourth ray diverge, (iv) the forth ray and the fifth ray diverge, (v) the second ray and the fifth ray converge.

2. The method of claim 1, wherein the covering is connected to each of the third extension portion and the fourth extension portion during step (c).

3. The method of claim 1, wherein:

the supplemental component further includes a fifth extension portion that terminates in a fifth unsupported end, and step (e) further includes securing the fifth extension portion in fixed relation to the second extension portion.

4. The method of claim 1, wherein:

the supplemental component further includes a fifth extension portion that terminates in a fifth unsupported end, the portable barrier further includes a coupler configured to couple the fifth extension portion to the second extension portion, and step (e) further includes securing the fifth extension portion to the second extension portion with the coupler.

5. The method of claim 1, wherein:

the flooring includes a first segment of fabric material, and the covering includes a second segment of fabric material.

6. The method of claim 1, wherein:

the flooring is connected to both the first extension portion and the second extension portion during step (a), and the covering is connected to both the third extension portion and the fourth extension portion during step (c).

7. The method of claim 1, further comprising:

supporting the flooring on the ground after step (b).

8. The method of claim 1, further comprising:

limiting movement of the first extension portion and the second extension portion away from each other with the flooring.

9. The method of claim 1, further comprising:

limiting movement of the third extension portion and the fourth extension portion away from each other with the covering.

10. The method of claim 1, wherein:

step (c) includes the step of moving the third extension portion and the fourth extension portion away from each other, and the covering is connected to each of the third extension portion and the fourth extension portion during step (c).

11. The method of claim 1, wherein:

step (a) includes the step of moving the first extension portion and the second extension portion away from each other, and the flooring is connected to each of the first extension portion and the second extension portion during step (a).

12. A method of setting up a portable barrier that includes (i) a junction assembly, (ii) a leg assembly including (A) a first leg having a first strut portion extending from the junction assembly, and a first extension portion that terminates in a first unsupported end, and (B) a second leg having a second strut portion extending from the junction assembly, and a second extension portion that terminates in a second unsupported end, (iii) an arm assembly including (A) a first arm having a third strut portion extending from the junction assembly, and a third extension portion that terminates in a third unsupported end, and (B) a second arm having a fourth strut portion extending from the junction assembly, and a fourth extension portion that terminates in a fourth unsupported end, (iv) a supplemental component having a fifth strut portion extending from the junction assembly, the supplemental component being movable with respect to the second arm, (v) a flooring configured to be moved between a collapsed flooring configuration and an expanded flooring configuration, and (vi) a covering configured to be moved between a collapsed covering configuration and an expanded covering configuration, the method comprising:

(a) moving the first leg and the second leg away from each other to an arrangement in which the first extension portion and the second extension portion are each supported on a substantially horizontal surface;

(b) moving the flooring from the collapsed flooring configuration to the expanded flooring configuration in response to step (a);

(c) moving the first arm and the second arm away from each other;

(d) moving the covering from the collapsed covering configuration to the expanded covering configuration in response to step (c), and (e) securing the supplemental component in fixed relation to the second leg after step (d), wherein, when the flooring is in the expanded flooring configuration and the covering is in the expanded covering configuration, an occupant space is defined between the flooring and the covering, wherein, after step (e): (i) the first strut portion is positioned to extend in a first direction away from the junction assembly and toward the horizontal surface, (ii) the second strut portion is positioned to extend in a second direction away from the junction assembly and toward the horizontal surface, (iii) the third strut portion is positioned to extend in a third direction away from the junction assembly and away from the horizontal surface, (iv) the fourth strut portion is positioned to extend in a fourth direction away from the junction assembly and away from the horizontal surface, and (v) the fifth strut portion is positioned to extend in a fifth direction away from the junction assembly and toward the horizontal surface, wherein after step (e) and when the portable barrier is viewed in a front elevational view: (i) the second strut portion is positioned to extend in the second direction away from the junction assembly so as to define a first ray, (ii) the fifth strut portion is positioned to extend in the fifth direction away from the junction assembly so as to define a second ray, and (iii) the first ray and the second ray converge, wherein the arm assembly further includes an intermediate arm positioned between the first arm and the second arm, the intermediate arm including (i) a sixth strut portion extending from the junction assembly, and (ii) an additional extension portion that terminates in an additional unsupported end, wherein the covering is further connected to the intermediate arm, and wherein after step (e), the sixth strut portion is positioned to extend in a sixth direction away from the junction assembly and away from the horizontal surface.

13. The method of claim 12, wherein the covering is connected to each of the third extension portion, the fourth extension portion, and the additional extension portion during step (c).

14. A method of setting up a portable barrier that includes (i) a junction assembly, (ii) a leg assembly including (A) a first leg having a first strut portion extending from the junction assembly, and a first extension portion that terminates in a first unsupported end, and (B) a second leg having a second strut portion extending from the junction assembly, and a second extension portion that terminates in a second unsupported end, (iii) an arm assembly including (A) a first arm having a third strut portion extending from the junction assembly, and a third extension portion that terminates in a third unsupported end, and (B) a second arm having a fourth strut portion extending from the junction assembly, and a fourth extension portion that terminates in a fourth unsupported end, (iv) a supplemental component having a fifth strut portion extending from the junction assembly, the supplemental component being movable with respect to the second arm, (v) a flooring configured to be moved between a collapsed flooring configuration and an expanded flooring configuration, and (vi) a covering configured to be moved between a collapsed covering configuration and an expanded covering configuration, the method comprising:

(a) moving the first leg and the second leg away from each other to an arrangement in which the first extension portion and the second extension portion are each supported on a substantially horizontal surface;

(b) moving the flooring from the collapsed flooring configuration to the expanded flooring configuration in response to step (a);

(c) moving the first arm and the second arm away from each other;

(d) moving the covering from the collapsed covering configuration to the expanded covering configuration in response to step (c), and (e) securing the supplemental component in fixed relation to the second leg after step (d), wherein, when the flooring is in the expanded flooring configuration and the covering is in the expanded covering configuration, an occupant space is defined between the flooring and the covering, and wherein, after step (e): (i) the first strut portion is positioned to extend in a first direction away from the junction assembly and toward the horizontal surface, (ii) the second strut portion is positioned to extend in a second direction away from the junction assembly and toward the horizontal surface, (iii) the third strut portion is positioned to extend in a third direction away from the junction assembly and away from the horizontal surface, (iv) the fourth strut portion is positioned to extend in a fourth direction away from the junction assembly and away from the horizontal surface, and (v) the fifth strut portion is positioned to extend in a fifth direction away from the junction assembly and toward the horizontal surface, wherein the supplemental component further includes a fifth extension portion that terminates in a fifth unsupported end, wherein the portable barrier further includes a coupler configured to couple the fifth extension portion to the second extension portion, and wherein step (e) further includes securing the fifth extension portion to the second extension portion with the coupler so that the fifth extension portion lies adjacent to the second extension portion.

* * * * *